US006846796B2

(12) United States Patent
Schmid

(10) Patent No.: US 6,846,796 B2
(45) Date of Patent: Jan. 25, 2005

(54) METHOD FOR PRODUCING NON-IONIC TENSIDE GRANULATES

(75) Inventor: Karl Heinz Schmid, Mettmann (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 10/257,700

(22) PCT Filed: Apr. 6, 2001

(86) PCT No.: PCT/EP01/03957
§ 371 (c)(1),
(2), (4) Date: Oct. 15, 2002

(87) PCT Pub. No.: WO01/79414
PCT Pub. Date: Oct. 25, 2001

(65) Prior Publication Data

US 2003/0130155 A1 Jul. 10, 2003

(30) Foreign Application Priority Data

Apr. 15, 2000 (DE) ..... 100 18 812

(51) Int. Cl.[7] ..... C11D 3/37; C11D 17/00; C11D 1/68

(52) U.S. Cl. ..... 510/446; 510/421; 510/434; 510/444; 510/470; 510/473; 510/475

(58) Field of Search ..... 510/421, 434, 510/444, 446, 470, 473, 475

(56) References Cited

U.S. PATENT DOCUMENTS

| | | | | |
|---|---|---|---|---|
| 1,985,424 | A | | 12/1934 | Piggott |
| 2,016,962 | A | | 10/1935 | Flint et al. |
| 2,703,798 | A | | 3/1955 | Schwartz |
| 3,676,338 | A | | 7/1972 | Fries et al. |
| 3,966,629 | A | | 6/1976 | Dumbrell |
| 4,062,647 | A | | 12/1977 | Storm et al. |
| 4,172,887 | A | | 10/1979 | Vanlerberghe et al. |
| 4,664,839 | A | | 5/1987 | Rieck |
| 4,737,306 | A | | 4/1988 | Wichelhaus |
| 4,765,976 | A | | 8/1988 | Grollier et al. |
| 4,816,553 | A | | 3/1989 | Baur et al. |
| 5,009,814 | A | | 4/1991 | Kelkenberg et al. |
| 5,356,607 | A | | 10/1994 | Just |
| 5,516,447 | A | * | 5/1996 | Bauer et al. ..... 252/89.1 |
| 5,536,431 | A | * | 7/1996 | Carduck et al. ..... 510/444 |
| 5,580,941 | A | | 12/1996 | Krause et al. |
| 5,610,131 | A | * | 3/1997 | Donoghue et al. ..... 510/444 |
| 5,705,169 | A | | 1/1998 | Stein et al. |
| 5,789,372 | A | | 8/1998 | Fabry |
| 5,830,956 | A | | 11/1998 | Stockhausen et al. |
| 5,866,530 | A | * | 2/1999 | Schmid et al. ..... 510/438 |
| 5,962,663 | A | | 10/1999 | Wachter et al. |
| 6,193,960 | B1 | | 2/2001 | Metzger et al. |

FOREIGN PATENT DOCUMENTS

| | | |
|---|---|---|
| DE | 2 334 899 | 1/1974 |
| DE | 35 26 405 | 2/1987 |

(List continued on next page.)

OTHER PUBLICATIONS

Biermann, et al., "Alkylpolyglucoside—Technologie und Eigenschaften", Starch/Stärke, vol. 45, VCH Verlagsgesellschaft mbH, Weinheim, (1993), pp. 281–288, not translated; no month given.

Salka, "Alkyl Polyglycosides Properties and Applications", Cosmetics & Toiletries, vol. 108, (Mar., 1993), pp. 89–94.

Kahre, et al, "Alkylpolyglycoside—Ein neues Konzept für Pflege und Verträglichkeit in der Kosmetik", SÖFW–Journal, vol. 121, No. 8, (1995), pp. 598, 600–601, 604–611, not translated; no month given.

Kelkenberg, "Detergenzien auf Zuckerbasis", Tenside Surfactants Detergents, vol. 25, Carl Hanser Verlag, München, (1988), pp. 8–13, not translated; no month given.

R. Lochhead et al., "Encyclopedia of Polymers and Thickeners for Cosemetics", Cosmetics & Toiletries, vol. 108, (May, 1993), pp. 95–114, 127–130, 132–135.

"Ullmann's Encyclopedia of Industrial chemistry", 5$^{th}$ Ed., vol. A6, Weinheim, Verlag Chemie, (1986), pp. 231–332, no month given.

Gesslein, et al., "Chitosan, a gift from the sea", HAPPI, vol. 27, (Oct., 1990), pp. 57 & 59.

Skaugrud, "Chitosan—New Biopolymer For Cosmetics & Drugs", Drug Cosm. Ind., Vol. 148, (May, 1991), pp. 24, 26 & 30.

Onsoyen, et al., "Adding Benefits to Cosmetic Formulations by Tailormade Chitosans", Seifen–Öle–Fette–Wachse, vol. 117, (1991), pp. 633–637, no month given.

Sannan, et al., "Studies on Chitin, 2", Makromol. Chem., vol. 177, (1976), pp. 3589–3600, no month given.

Falbe, "Surfactants in Consumer Products", Springer Verlag, Berlin, (1987), pp. 54–124, no month given Falbe, "Katalysatoren, Tenside und Mineralöladditive" (Catalysts, Surfactants and Mineral Oil Additives), Thieme Verlag, Stuttgart, (1978), pp. 123–217, not translated; no month given.

Todd, et al., "Volatile silicone fluids for cosmetic formulations", Cosmetics & Toiletries, vol. 91, (Jan., 1976), pp. 29–32.

H. Tronnier et al., "Experimentelle Untersuchungen zur Wirkungsweise aluminiumhaltiger Antiperspiranzien", J. Soc. Cosmetic Chemists, 24, (1973), pp. 281–290, not translated; no month given.

A.B. Graham et al., "Inhibition of the mitochondrial oxidation of octanoate by salicylic acid and related compounds", J. Pharm. Pharmac., 26, (1974), pp. 531–534, no month given.

"Kosmetische Färbemittel", Farbstoffkommission der Deutschen Forschungsgemeinschaft, Verlag CHemie, Weinheim, (1984), pp. 81–106, no month given.

*Primary Examiner*—Brian P. Mruk
(74) *Attorney, Agent, or Firm*—Aaron R. Ettelman

(57) ABSTRACT

Surfactant granules are made by the process comprising the steps of (1) mixing an aqueous nonionic surfactant paste and an aqueous solution of an organic polymeric carrier; (2) simultaneously granulating and drying the mixture from step (1) in a fluidized bed to form a granulated nonionic surfactant. The surfactant granules are dust-free, flowable, storage-stable, show no tendency toward clumping and are readily soluble in cold water.

12 Claims, No Drawings

FOREIGN PATENT DOCUMENTS

| | | | | |
|---|---|---|---|---|
| DE | 37 13 099 | | 10/1987 | |
| DE | 39 14 131 | | 10/1990 | |
| DE | 41 02 745 | | 8/1992 | |
| DE | 41 39 551 | | 6/1993 | |
| DE | 42 21 381 | | 2/1994 | |
| DE | 43 00 772 | | 7/1994 | |
| DE | 43 09 567 | | 9/1994 | |
| DE | 43 26 959 | | 2/1995 | |
| DE | 44 00 632 | | 3/1995 | |
| DE | 44 42 987 | | 6/1996 | |
| DE | 195 37 001 | | 3/1997 | |
| DE | 196 04 180 | | 8/1997 | |
| DE | 198 24 742 | | 12/1999 | |
| DE | 19824742 | * | 12/1999 | ..... C11D/3/22 |
| EP | 0 026 529 | | 4/1981 | |
| EP | 0 028 432 | | 5/1981 | |
| EP | 0 164 514 | | 12/1985 | |
| EP | 0 280 223 | | 8/1988 | |
| EP | 0 285 768 | | 10/1988 | |
| EP | WO 93/19155 | * | 9/1993 | ..... C11D/11/00 |
| EP | 0 694 521 | | 1/1996 | |
| EP | 0 818 450 | | 1/1998 | |
| EP | 0 859 048 | | 8/1998 | |
| EP | 859048 | * | 8/1998 | ..... C11D/17/06 |
| FR | 1 580 491 | | 9/1969 | |
| FR | 2 252 840 | | 8/1975 | |
| FR | 2 701 266 | | 8/1994 | |
| FR | 2 785 198 | | 5/2000 | |
| FR | 2785198 | * | 5/2000 | ..... B01J/2/28 |
| GB | 1 400 898 | | 7/1975 | |
| WO | 91/08171 | | 6/1991 | |
| WO | 92/06153 | | 4/1992 | |
| WO | 92/06154 | | 4/1992 | |
| WO | 92/06155 | | 4/1992 | |
| WO | 92/06156 | | 4/1992 | |
| WO | 92/06157 | | 4/1992 | |
| WO | 92/06158 | | 4/1992 | |
| WO | 92/06159 | | 4/1992 | |
| WO | 92/06160 | | 4/1992 | |
| WO | 92/06161 | | 4/1992 | |
| WO | 92/06162 | | 4/1992 | |
| WO | 92/06164 | | 4/1992 | |
| WO | 92/06170 | | 4/1992 | |
| WO | 92/06171 | | 4/1992 | |
| WO | 92/06172 | | 4/1992 | |
| WO | 92/06984 | | 4/1992 | |
| WO | 95/06152 | | 4/1992 | |
| WO | 93/19155 | | 9/1993 | |
| WO | 95/14519 | | 6/1995 | |

* cited by examiner

METHOD FOR PRODUCING NON-IONIC TENSIDE GRANULATES

BACKGROUND OF THE INVENTION

The invention relates to surfactant granulates which are obtained by granulating aqueous pastes of nonionic surfactants in the presence of organic polymeric carriers and simultaneously drying them, to a method for producing them, and to the use thereof in surface-active preparations.

PRIOR ART

Nonionic surfactants, such as, for example, alkyl oligoglucosides, are characterized by excellent detergency properties and high ecotoxicological compatibility. For this reason, these classes of nonionic surfactants are increasingly gaining in importance. If they have hitherto usually been used in liquid formulations, such as, for example, dishwashing detergents or hair shampoos, then there is likewise a great market need for solid, anhydrous supply forms which, for example, can also be incorporated into solid detergents and cosmetics.

In this connection, "detergents" is to be understood as meaning not only powder detergents, but primarily also detergents in piece form, such as, for example, detergent tablets. Particularly in the case of the latter, it has been found that the use of solid nonionic surfactant granulates can prevent migration and penetration of the nonionic surfactant into other constituents of the detergent tablet, e.g. into the so-called "disintegrant" constituent, whereas in the case of conventional preparation where the nonionic surfactant is distributed over the entire detergent powder by spraying before it is compressed to give tablets penetration of the nonionic surfactant into the "disintegrant" results, the latter then losing its effectiveness, meaning that the rapid disintegration of the tablet at the start of the washing process is delayed or prevented entirely.

In the case of cosmetic products, the advantage of using solid nonionic surfactant granulates is, by contrast, the fact that these anhydrous products are inert toward fungi, yeasts and bacteria upon storage even without preservatives, and that this micro-biological stability is achieved even when the solid anhydrous surfactant has a neutral pH.

This accommodates the consumer who requires cosmetic products which are free from preservatives.

For the manufacturers of detergent and cosmetic products, the solid anhydrous nonionic surfactants can then only be used if these products are easy to incorporate during the manufacture of detergent and cosmetics products. It is therefore essential that the solid anhydrous nonionic surfactants have good flowability, so that they can be traded in silo tankers or "big bags". Furthermore, the solid, anhydrous nonionic surfactants must also be dust-free so that they do not present any risk of a dust explosion while being processed, and there is no danger of impairment to the health of processing personnel, e.g. as a result of inhalation of surfactant dusts.

The drying of liquid surfactant preparations is usually carried out industrially by conventional spray drying in which the aqueous surfactant paste is sprayed at the head of a spraying tower in the form of fine droplets, countercurrently to which hot drying gases are passed. German patent application DE 4102745 A1 (Henkel), for example, discloses a process in which a small amount of from 1 to 5% by weight of alkyl glucosides is added to fatty alcohol sulfate pastes and the mixture is subjected to conventional spray drying. However, the process can only be carried out in the presence of a large amount of inorganic salts. German patent application DE 4139551 A1 (Henkel) proposes the spraying of pastes of alkyl sulfates and alkyl glucosides, but which can at most contain 50% by weight of the sugar surfactant, in the presence of mixtures of soda and zeolite. Here, however, only compounds are obtained which have a low surfactant concentration and an inadequate bulk density. Finally, international patent application WO 95/14519 (Henkel) reports on subjecting surfactant pastes to drying with superheated steam. This process is, however, technically very complex.

The complex object of the invention was thus to provide a simple method for producing nonionic surfactant granulates in which the presence of inorganic compounds such as, for example, soda, zeolites and inorganic salts, can be dispensed with. Moreover, this method should make available granulates which are characterized by high surfactant contents, high bulk densities and good color quality and simultaneously are dust-free, flowable and storage-stable. Furthermore, these nonionic surfactant granulates should rapidly dissolve in water even at low temperatures, e.g. at 20° C.

DESCRIPTION OF THE INVENTION

The invention provides surfactant granulates obtainable by granulating aqueous pastes of nonionic surfactants in the presence of organic polymeric carrier materials (also called organic polymer below) and simultaneously drying them.

The invention further provides a method for producing surfactant granulates in which aqueous pastes of nonionic surfactants are granulated in the presence of organic polymeric carrier materials and simultaneously dried.

Surprisingly, it has been found that by using organic polymeric carrier materials without the addition of inorganic compounds, such as, for example, zeolites or soda, nonionic surfactant granulates are obtained. Particularly surprising is the finding that it has proven even more advantageous to granulate the aqueous nonionic surfactant pastes not together with the solid organic polymers in a fluidized bed and to simultaneously dry them, but to initially dissolve the organic polymers in the aqueous surfactant paste and then to granulate the aqueous mixture of surfactant and polymer jointly in a fluidized bed and to dry them. In this case, the organic polymer is not only a carrier material, but also a structure-improver. The surfactant granulates according to the invention are characterized by an unexpectedly high bulk density in the range from 600 to 1000 g/l. The granulates are, even in the case of a residual water content of up to 20% by weight, dry on the outside, meaning that subsequent drying is not required. They are dust-free, flowable, storage-stable, show no tendency toward clumping and are readily soluble even in cold water, virtually without residue. In addition, they have excellent color quality.

Nonionic Surfactants

Suitable nonionic surfactants are alkyl and alkenyl oligoglycosides, fatty acid N-alkylpolyhhydroxyalkylamides, alcohol ethoxylates, alkoxylated carboxylic esters, preferably alkyl and alkenyl oligoglycosides.

Alkyl and/or Alkenyl Oligoglycosides

Alkyl and/or alkenyl oligoglycosides are known nonionic surfactants which conform to the formula (I)

$$R^1O—[G]_p \quad (I)$$

in which $R^1$ is an alkyl and/or alkenyl radical having 4 to 22 carbon atoms, G is a sugar radical having 5 or 6 carbon atoms and p is numbers from 1 to 10. They can be obtained by the relevant methods of preparative organic chemistry. By way of representation for the extensive literature, reference may be made here to the review work by Biermann et al. in Starch 45, 281 (1993), B. Salka in Cosm. Toil. 108, 89 (1983) and J. Kahre et al. in SÖFW Journal Vol. 8, 598 (1995).

The alkyl and/or alkenyl oligoglycosides can be derived from aldoses or ketoses having 5 or 6 carbon atoms, preferably glucose. The preferred alkyl and/or alkenyl oligoglycosides are thus alkyl and/or alkenyl oligoglucosides. The index number p in the general formula (I) gives the degree of oligomerization (DP), i.e. the distribution of mono- and oligoglycosides and is a number between 1 and 10. While p in a given compound must always be a whole number and here can primarily assume the values p=1 to 6, the value p for a certain alkyl oligoglycoside is an analytically determined parameter which is in most cases a fraction. Preference is given to using alkyl and/or alkenyl oligoglycosides with an average degree of oligomerization p of from 1.1 to 3.0. From a performance viewpoint, preference is given to those alkyl and/or alkenyl oligoglycosides whose degree of oligomerization is less than 1.7 and is in particular between 1.2 and 1.6. The alkyl or alkenyl radical $R^1$ can be derived from primary alcohols having 4 to 11, preferably 8 to 10, carbon atoms. Typical examples are butanol, caproic alcohol, caprylic alcohol, capric alcohol and undecyl alcohol, and technical-grade mixtures thereof, as are obtained, for example, in the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3), which are produced as forerunnings in the distillative separation of technical-grade $C_8$–$C_{18}$-coconut fatty alcohol and may be contaminated with a content of less than 6% by weight of $C_{12}$-alcohol, and also alkyl oligo-glucosides based on technical-grade $C_{9/11}$-, $C_{12/13}$-, $C_{12/15}$- and $C_{14/15}$-oxo alcohols (DP=1 to 3). Particular preference is given to technical-grade oxo alcohols from Shell, which are marketed under the name Dobanol® and Neodol®. The alkyl or alkenyl radical $R^1$ can also be derived from primary alcohols having 12 to 22, preferably 12 to 18, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and technical-grade mixtures thereof, which can be obtained as described above. Preference is given to alkyl oligoglucosides based on hydrogenated $C_{12/14}$-coconut or palm kernel alcohol or $C_{16/18}$-fatty alcohol from coconut, palm kernel or palm oil with a DP of 1 to 3.

Fatty Acid N-alkylpolyhydroxyalkylamides

Fatty acid N-alkylpolyhydroxyalkylamides are nonionic surfactants which conform to the formula (I)

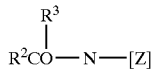

(I)

in which $R^2CO$ is an aliphatic acyl radical having 6 to 22 carbon atoms, $R^3$ is an alkyl or hydroxyalkyl radical having 1 to 4 carbon atoms and [Z] is a linear or branched polyhydroxyalkyl radical having 3 to 12 carbon atoms and 3 to 10 hydroxyl groups. The fatty acid N-alkylpolyhydroxyalkylamides are known substances which can usually be obtained by reductive amination of a reducing sugar with an alkylamine or an alkanolamine and subsequent acylation with a fatty acid, a fatty acid alkyl ester or a fatty acid chloride. With regard to the processes for their preparation, reference may be made to the US patent specifications U.S. Pat. No. 1,985,424, U.S. Pat. No. 2,016,962 and U.S. Pat. No. 2,703,798, and the international patent application WO 92/06984. A review of this topic by H. Kelkenberg is given in Tens. Surf. Deterg. 25, 8 (1988).

The fatty acid N-alkylpolyhydroxyalkylamides are preferably derived from reducing sugars having 5 or 6 carbon atoms, in particular from glucose. The preferred fatty acid N-alkylpolyhydroxyalkylamides are therefore fatty acid N-alkylglucamides, and are given by the formula (II):

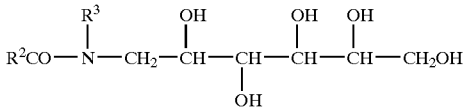

(II)

The fatty acid N-alkylpolyhydroxyalkylamides used are preferably glucamides of the formula (II) in which $R^3$ is an alkyl group and $R^2CO$ is an acyl radical of caproic acid, caprylic acid, capric acid, lauric acid, myristic acid, palmitic acid, palmoleic acid, stearic acid, isostearic acid, oleic acid, elaidic acid, petroselic acid, linoleic acid, linolenic acid, arachidic acid, gadoleic acid, behenic acid or erucic acid or technical-grade mixtures thereof. Particular preference is given to fatty acid N-alkylglucamides of the formula (II) which are obtained by reductive amination of glucose with methylamine and subsequent acylation with lauric acid or $C_{12/14}$-coconut fatty acid or a corresponding derivative. In addition, the polyhydroxyalkylamides can also be derived from maltose and palatinose.

The use of fatty acid N-alkylpolyhydroxyalkylamides is also the subject of a large number of publications. For example, European patent application HP 0285768 Al (Hüls) discloses its use as thickener. French laid-open specification FR 1580491 A (Henkel) describes aqueous detergent mixtures based on sulfates and/or sulfonates, nonionic surfactants and optionally soaps which comprise fatty acid N-alkylglucamides as foam regulators. Mixtures of short- and longer-chain glucamides are described in German patent specification DE 4400632 C1 (Henkel). German laid-open specifications DE 4326959 A1 and DE 4309567 A1 (Henkel) also report on the use of glucamides with longer alkyl radicals as pseudoceramides in skin care compositions, and on combinations of glucamides with protein hydrolyzates and cationic surfactants in hair care products. The subject-matter of international patent applications WO 92/06153, WO 92/06156, WO 92/06157, WO 92/06158, WO 92/06159 and WO 92/06160 (Procter & Gamble) are mixtures of fatty acid N-alkylglucamides with anionic surfactants, surfactants with sulfate and/or sulfonate structure, ethercarboxylic acids, ethersulfates, methyl ester sulfonates and nonionic surfactants. The use of these substances in extremely diverse laundry detergents, dishwashing detergents and cleaners is described in the international patent applications WO 92/06152, WO 92/06154, WO 92/06155, WO 92/06161, WO 92/06162, WO 92/06164, WO 92/06170, WO 92/06171 and WO 92/06172 (Procter & Gamble).

Alcohol Ethoxylates

Alcohol ethoxylates are referred to as fatty alcohol ethoxylates or oxo alcohol ethoxylates as a consequence of the preparation and preferably conform to the formula (III)

$$R^4\ O(CH_2CH_2O)_nH \quad (III)$$

in which $R^4$ is a linear or branched alkyl and/or alkenyl radical having 6 to 22 carbon atoms and n is numbers from 1 to 50. Typical examples are the adducts of, on average, 1 to 50, preferably 5 to 40 and in particular 10 to 25, mol onto caproic alcohol, caprylic alcohol, 2-ethylhexyl alcohol capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol, and technical-grade mixtures thereof which are produced, for example, during the high-pressure hydrogenation of technical-grade methyl esters based on fats and oils or aldehydes from the Roelen oxo synthesis, and as monomer fraction during the dimerization of unsaturated fatty alcohols. Preference is given to adducts of from 10 to 40 mol of ethylene oxide onto technical-grade fatty alcohols having 12 to 18 carbon atoms, such as, for example, coconut, palm, palm kernel or tallow fatty alcohol.

Alkoxylated Carboxylic Esters

Alkoxylated carboxylic esters are known from the prior art. Thus, for example, such alkoxylated carboxylic esters are obtainable by esterification of alkoxylated carboxylic acids with alcohols. For the purposes of the present invention, however, the compounds are preferably prepared by reacting carboxylic esters with alkylene oxides using catalysts, in particular using calcined hydrotalcite according to German laid-open specification DE 3914131 A, which produces compounds with a narrowed homolog distribution. By this process it is possible to alkoxylate both carboxylic esters of monohydric alcohols and also of polyhydric alcohols. According to the present invention, preference is given to alkoxylated carboxylic esters of monohydric alcohols which conform to the general formula (IV)

$$R^5CO(OAlk)_nOR^6 \quad (IV)$$

in which $R^5CO$ is an aliphatic acyl radical derived from a carboxylic acid, alkO is alkylene oxide and $R^6$ is an aliphatic alkyl radical derived from a monohydric aliphatic alcohol. Particularly suitable are alkoxylated carboxylic esters of the formula (IV) in which $R^5C0$ is an aliphatic acyl radical having 6 to 30, preferably 6 to 22 and in particular 10 to 18, carbon atoms, alkO is a $CH_2CH_2O$, $CHCH_3CH_2O$ and/or $CH_2$—$CHCH_3O$ radical, n is, on average, numbers from 1 to 30, preferably 5 to 20 and in particular 10 to 15, and $R^6$ is an aliphatic alkyl radical having 1 to 4 and preferably 1 and/or 2 carbon atoms.

Preferred acyl radicals are derived from carboxylic acids having 6 to 22 carbon atoms of natural or synthetic origin, in particular from linear, saturated and/or unsaturated fatty acids including technical-grade mixtures thereof, and are obtained by fat cleavage from animal and/or vegetable fats and oils, for example from coconut oil, palm kernel oil, palm oil, soybean oil, sunflower oil, rapeseed oil, cotton wool seed oil, fish oil, beef tallow and lard. Examples of such carboxylic acids are caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and/or erucic acid.

Preferred alkyl radicals are derived from primary, aliphatic, monofunctional alcohols having 1 to 4 carbon atoms, which may be saturated and/or unsaturated. Examples of suitable monoalcohols are methanol, ethanol, propanol, and butanol, in particular methanol.

AlkO stands for the alkylene oxides which are reacted with the carboxylic esters and include ethylene oxide, propylene oxide and/or butylene oxide, preferably ethylene oxide and/or propylene oxide, in particular ethylene oxide on its own.

Particularly suitable are alkoxylated carboxylic esters of the formula (IV) in which alkO is a $CH_2CH_2O$ radical, n is, on average, numbers from 10 to 15 and $R^2$ is a methyl radical. Examples of such compounds are lauric acid methyl ester, coconut fatty acid methyl ester and tallow fatty acid methyl ester, alkoyxlated with, on average, 5, 7, 9 or 11 mol of ethylene oxide.

The nonionic surfactants can be used in amounts of from 20 to 95, preferably 50 to 80 and in particular 60 to 70, based on the final concentration.

Organic Polymeric Carrier Materials

Suitable organic polymeric carrier materials are cationic, anionic, zwitterionic, amphoteric and/or nonionic organic polymers. In a preferred embodiment of the invention, organic polymers which can be used are poly(meth) acrylates, polypeptides, polysaccharides, celluloses, polyvinyl alcohols, polyvinyl pyrrolidone, polycondensates, polyhydroxycarboxylic acids, poly-ethylene glycol, polyesters, polyurethanes and/or derivatives thereof.

Suitable organic cationic polymers are, for example, cationic cellulose derivatives, such as, for example, a quaternized hydroxyethylcellulose which is available under the name Polymer JR 400® from Amerchol, cationic starch, copolymers of diallylammonium salts and acrylamides, quaternized vinylpyrrolidone/vinyl-imidazole polymers, such as, for example, Luviquat® (BASF), condensation products of polyglycols and amines, quaternized collagen polypeptides, such as, for example, lauryldimonium hydroxypropyl hydrolyzed collagen (Lamequat®L/Grünau), quaternized wheat polypeptides, polyethyleneimine, cationic silicone polymers, such as, for example, amodimethicones, copolymers of adipic acid and dimethylaminohydroxypropyldiethylenetriamine (Cartaretins®/Sandoz), copolymers of acrylic acid with dimethyldiallylammonium chloride (Merquat®550/Chemviron), polyaminopolyamides, as described, for example, in FR 2252840 A, and their crosslinked water-soluble polymers, cationic chitin derivatives, such as, for example, quaternized chitosan, optionally in microcrystalline distribution, condensation products of dihaloalkyls, such as, for example, dibromobutane with bisdialkylamines, such as, for example, bisdimethylamino-1,3-propane, cationic guar gum, such as, for example, Jaguar® CBS, Jaguar® C-17, Jaguar® C-16 from Celanese, quaternized ammonium salt polymers, such as, for example, Mirapol® A-15, Mirapol® AD-1, Mirapol® AZ-1 from Miranol.

Suitable organic anionic, zwitterionic, amphoteric and nonionic polymeric carriers are, for example, vinyl acetate/crotonic acid copolymers, vinylpyrrolidone/vinyl acrylate copolymers, vinyl acetate/butyl maleate/isobornyl acrylate copolymers, methyl vinyl ether/maleic anhydride copolymers and esters thereof, acrylamidopropyltrimethylammonium chloride/acrylate copolymers, octylacrylamide/methyl methacrylate/tertbutylaminoethyl methacrylate/2-hydroxypropyl methacrylate copolymers, polyvinylpyrrolidone, vinylpyrrolidone/vinyl acetate copolymers, vinylpyrrolidone/dimethylaminoethyl methacrylate/vinylcaprolactam terpolymers, and optionally derivatized cellulose ethers. Other suitable polymers and thickeners are listed in Cosmetics & Toiletries Vol. 108, May 1993, page 95ff.

In a preferred embodiment of the invention, suitable organic polymeric carriers are poly(meth)acrylates, polypeptides, polysaccharides, cellulose, polyvinyl alcohols, polyvinylpyrrolidones, polycondensates, polyhydroxycarboxylic acids and/or derivatives thereof.

(1) Poly(meth)acrylates

Suitable poly(meth)acrylates are polymeric compounds which can be formed from acrylic acid or methacrylic acid, and derivatives thereof known from the prior art. Preference is given to using polyacrylate/methacrylate (e.g. Sokalan® CP 5; BASF) and polyacrylates such as, for example, Carbopols® and Pemulen grades from Goodrich; Synthalens® from Sigma; Keltrol grades from Kelco; Sepigel grades from Seppic; Salcare grades from Allied Colloids).

(2) Proteins

Suitable proteins for the purposes of the invention are polypeptides based on animal protein (e.g. collagen) or based on vegetable protein with a molecular weight of from 1000 to 300 000, preferably 5000 to 200 000 and in particular 10 000 to 150 000.

In a particular embodiment, water-soluble proteins are used, e.g. based on wheat protein. In this case, a molecular weight of from 5000 to 50 000 is particularly preferred. Corresponding proteins based on whey, soybean, rice and silk can likewise be used.

Particular preference is given to using protein hydrolyzates with an average molecular weight of from 500 to 30 000 (e.g. Gluadin® WP, from Cognis GmbH). In a preferred embodiment of the invention, anionically or cationically modified protein hydrolyzates (e.g. Gluadin WQ; Cognis GmbH) can likewise be used.

Polypeptides can also be formed by a known route from amino acids and derivatives thereof, i.e. from carboxylic acids with one or more amino groups in the molecule. For the purposes of the invention, the proteins and polypeptides can be prepared by linkage of the individual amino acids and any desired combination thereof with one another. Here, examples of suitable amino acids are glycine, alanine, serine, cysteine, phenylalanine, tyrosine, tryptophan, threonine, methionine, valine, proline, leucine, isoleucine, lysine, arginine, histidine, L-aspartic acid, asparagine, glutamic acid, glutamine and derivatives thereof (for example polyethylene glutamate) which, after the derivatization, contain at least one COOH and at least one amino group. Polyaspartate (for example with MW 20 000 (Donlar) or with MW 2000–3000 (Bayer) are preferably suitable.

(3) Polysaccharides and/or Derivatives Thereof

Suitable polysaccharides are all types of sugar known from the prior art, starch, degraded starch (e.g. liquid syrup), glycogen, cellulose and derivatives thereof. As polysaccharides, preference is given to using starch, cellulose and derivatives thereof and, in particular, xanthan gum, guar guar (e.g. guarhydroxy-propyltrimethylammonium chloride; Cosmedia Guar C 261; Cognis GmbH; guar flour; Cosmedia Guar U, Cognis GmbH), agar agar, alginates and Tyloses, carboxymethylcellulose and hydroxyethylcellulose, dextrin, cyclodextrin, carboxymethyldextran and derivatives thereof.

Chitin is to be understood as meaning polysaccharides of the general formula $(C_8H_{13}NO_s)_x$ which contain amino sugars and which usually have molecular weights in the order of magnitude of, on average, 30 000 to 5 000 000 daltons. Chitins consist of chains of β-1,4-glycosidically linked N-acetyl-D-glucosamine radicals. Particular preference is given to the use of chitin with a molecular weight of from 50 000 to 2 000 000 daltons.

Chitosans are, inter alia, biopolymers and belong to the group of hydrocolloids. From a chemical viewpoint, they are partially deacetylated chitins, i.e. amino-sugar-containing polysaccharides of varying molecular weight which contain the following—idealized —monomer building block:

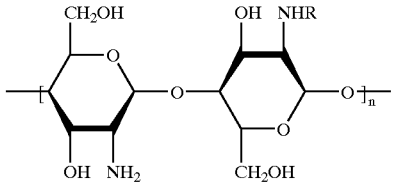

In contrast to most hydrocolloids, which are negatively charged in the range of biological pH values, chitosans are cationic biopolymers under these conditions. The positively charged chitosans can interact with oppositely charged surfaces and are therefore used in cosmetic hair care and body care compositions and also pharmaceutical preparations (cf. Ullmann's Encyclopedia of Industrial Chemistry, 5th Ed., Vol. A6, Weinheim, Verlag Chemis, 1986, p. 231–232). Reviews on this topic have also appeared, for example, by B. Gesslein et al. in HAPPI 27, 57 (1990), O. Skaugrud in Drug Comm. Ind. 148, 24 (1991) and E. Onsoyen et al., in Seifen-Öle-Fette-Wachae 117, 633 (1991). Chitosans are prepared from chitin, preferably the shell remains of crustaceans, which are available in large amounts as inexpensive raw materials. In a process which has been described for the first time by Hackmann et al., the chitin is here usually firstly deproteinated by the addition of bases, demineralized by the addition of mineral acids and, finally, deacetylated by the addition of strong bases, it being possible for the molecular weights to be spread over a broad spectrum. Corresponding processes are known, for example, from Makromol. Chem. 177, 3589 (1976) or the French patent application FR 2701266 A. Preference is given to using those grades disclosed in German patent applications DE 4442987 A1 and DE 19537001 A1 (Henkel) and which have an average molecular weight of from 10 000 to 5 000 000 daltons, in particular 10 000 to 500 000 or 800 000 to 1 200 000 daltons and/or have a Brookfield viscosity (1% strength by weight in glycolic acid) of less than 5000 mPas, a degree of deacetylation in the range from 80 to 88% and an ash content of less than 0.3% by weight. Usually, chitosans with an average molecular weight of from 10 000 to 5 000 000 daltons are used, in a preferred embodiment chitosans with an average molecular weight of from 30 000 to 100 000 daltons are used, also preferred are chitosans with a molecular weight of from 100 000 to 1 000 000 daltons, and particular preference is given to chitosans with a molecular weight of from 800 000 to 1 000 000 daltons.

In addition to the chitosans as typical cationic biopolymers, for the purposes of the invention, anionically or nonionically derivatized chitosans, such as, for example, carboxylation, succinylation or alkoxylation products, are also suitable, as are described, for example, in German patent specification DE 3713099 C2 (L'Oréal) and German patent application DE 19604180 A1 (Henkel).

(4) Polyvinyl Alcohols

For the purposes of the invention, polymers have the general structure —$CH_2CHOH$—$CH_2$—$CH_2OH$— which may also contain small amounts (about 2%) of structural units of the type —$CH_2CHOH$—CHOH—$CH_2OH$—. Polyvinyl alcohols cannot be obtained directly by polymerization of vinyl alcohol ($H_2C$=CH—OH) since its concentration in the tautomer equilibrium (keto-enol tautomerism) with acetaldehyde ($H_3C$—CHO) is too low. Polyvinyl alcohols are therefore prepared primarily from polyvinyl acetates via polymer-analogous reactions such as hydrolysis, but industrially in particular by alkaline-catalyzed transesterification with alcohols (preferably methanol) in solution. For the purposes of the invention, polyvinyl alcohols, which are supplied as white-yellowish powders or granules with degrees of polymerization in the range from, preferably, 500 to 2500 (molar masses of about 20 000–100 000 g/mol), will preferably have degrees of hydrolysis of from 98 to 99 or 87 to 89 molt, i.e. still have a residual content of acetyl groups. Suitable products preferably have a molecular weight of from 5000 to 50 000 and in particular 10 000 to 30 000.

(5) Polyvinylpyrrolidones

Polyvinylpyrrolidones [poly(1-vinyl-2-pyrrolidinones) are prepared by free-radical polymerization of 1-vinylpyrrolidone by the processes of bulk, solution or suspension polymerization using free radical formers (peroxides, azo compounds) as initiators and in most cases in the presence of aliphatic amines, which suppress the decomposition of the monomer which takes place in the acidic medium. The ionic polymerization of the monomer produces only products with low molar masses.

Polyvinylpyrrolidones with molar masses in the range from 2500 to 75 000, particularly preferably 5000 to 60 000 and in particular in the range from 20 000 to 50 000 g/mol are preferably suitable.

(6) Polycondensates

Suitable polypeptides are copolymers of polypeptides with dicarboxylic acids (for example poly-β-alanine/glutaric acid copolymers), vinylpyrrolidone and vinyl acetates, polyols and poly(meth)acrylates.

(7) Polyhydroxycarboxylic Acids

The polyhydroxycarboxylic acids which may be used are also copolymers of vinyl alcohol and (meth)acrylic acids. A particular embodiment involves polyhydroxycarboxylic acids which are prepared by polycondensation of polyhydroxy acids such as tartaric acid, citric acid, malic acid, and mixtures thereof.

The organic polymeric carrier materials can be used in amounts of from 0.1 to 50, preferably 1 to 30 and in particular 5 to 20, based on the final concentration.

Fluidized-bed Granulation

Fluidized-bed or SKET granulation is to be understood as meaning a granulation with simultaneous drying which preferably takes place batchwise or continuously in the fluidized bed. In this connection, the nonionic surfactants can preferably be introduced into the fluidized bed in the form of aqueous pastes simultaneously or one after the other via one or more nozzles. Preferred fluidized-bed apparatuses have base plates with dimensions of from 0.4 to 5 m. The SKET granulation is preferably carried out at fluidized-air speeds in the range from 1 to 8 m/s. The granulates are discharged from the fluidized bed preferably via a size classification of the granulates. Classification can take place, for example, by means of a screen device or by means of a countercurrent stream of air (sifter air), which is regulated such that only particles above a certain particle size are removed from the fluidized bed and the smaller particles are retained in the fluidized bed. The air which flows in is usually composed of the heated or unheated sifter air and the heated base air. The base air temperature here is between 60 and 400° C., preferably between 60 and 350° C. Advantageously, at the start of the SKET granulation, an organic polymeric carrier material or a SKET granulate from an earlier experimental batch is initially introduced as starting mass. In the fluidized bed, the water evaporates from the surfactant paste which, in addition to the surfactant, also comprises the polymer, giving rise to partially dried to dried nuclei which are coated with further amounts of surfactant/polymer mixture, granulated and in turn simultaneously dried. The result is a surfactant/polymer particle with a surfactant gradient over the particle which is particularly readily soluble in water. The granulation with simultaneous drying can be carried out without the addition of inorganic salts, for example, zeolite and soda.

In a preferred embodiment of the invention, these surfactant granulates have a particle size distribution between 0.02 and 2.0 mm and in particular between 0.2 and 1.6 mm. In a further preferred embodiment of the invention, at least 70% by weight, particularly preferably 75 and in particular 85% by weight, of the granulates consist of round particles.

Preferred Embodiments of the Granulation

The process according to the invention can be carried out in two embodiments, either in a mixer or in a fluidized bed. The granulation is preferably carried out in a fluidized bed or in a fluidized-bed spray tower. Firstly, it is possible to initially introduce the organic polymeric carriers as crystallization nucleus and to spray on an extremely highly concentrated, for example 30 to 65% strength by weight, paste of a nonionic surfactant. Secondly, an organic polymer or mixtures of different polymers can, in cases where these are water-soluble, also be dissolved in the nonionic aqueous surfactant pastes or, in cases where they are insoluble in water, be mixed to give a type "slurry" and then be sprayed jointly or preferably granulated and dried simultaneously by a countercurrent stream of hot air.

Surfactants

Although the object of the invention is directed toward the preparation of nonionic surfactant granulates, further anionic, nonionic, amphoteric or zwitterionic and cationic surfactants can also be used together with these surfactants. Typical examples of anionic surfactants are soaps, alkylbenzenesulfonates, alkanesulfonates, olefinsulfonates, alkyl ether sulfonates, glycerol ether sulfonates, α-methyl ester sulfonates, sulfofatty acids, alkyl sulfates, fatty alcohol ether sulfates, glycerol ether sulfates, fatty acid ether sulfates, hydroxy mixed ether sulfates, monoglyceride (ether) sulfates, fatty acid amide (ether) sulfates, mono- and dialkyl sulfosuccinates, mono- and dialkylsulfosuccinamates, sulfotriglycerides, amide soaps, ethercarboxylic acids and salts thereof, fatty acid isethionates, fatty acid sarcosinates, fatty acid taurides, N-acylamino acids, such as, for example, acyl lactylates, acyl tartrates, acyl glutamates and acyl aspartates, alkyl oligoglucoside sulfates, protein fatty acid condensates (in particular wheat-based vegetable products) and alkyl (ether) phosphates. If the anionic surfactants contain polyglycol ether chains, then these can have a conventional homolog distribution, but preferably have a narrowed homolog distribution. Typical examples of nonionic surfactants are fatty alcohol polyglycol ethers, alkylphenol polyglycol ethers, fatty acid amide polyglycol ethers, fatty amine polyglycol ethers, alkoxylated triglycerides, mixed ethers and mixed formals, and glucuronic acid derivatives, fatty acid N-alkylglucamides, protein hydrolyzates (in particular vegetable products based on wheat), polyol fatty acid esters, sorbitan esters, polysorbates and amine oxides. If the nonionic surfactants contain polyglycol ether chains, then these can have a conventional homolog distribution, but preferably have a narrowed homolog distribution. Typical examples of cationic surfactants are quaternary ammonium compounds, such as, for example, dimethyldistearylammonium chloride or alkyltrimethylammonium chloride, and ester quats, in particular quaternized fatty acid trialkanolamine ester salts. Typical examples of amphoteric or zwitterionic surfactants are alkylbetaines, alkylamidobetaines (such as cocamidopropylbetaine), aminopropionateb, aminoglycinates, imidazoliniumbetaines and sulfobetaines. Said surfactants are exclusively known compounds. With regard to structure and preparation of these substances, reference may be made to relevant review works, for example J. Falbe (ed.), "Surfactants in Consumer Products", Springer Verlag, Berlin, 1987, p. 54–124 or J. Falbe (ed.), "Katalysatoren, Tenside und Mineralöladditive", Thieme Verlag, Stuttgart, 1978, p. 123–217. Typical examples of particularly suitable mild, i.e. particularly skin-compatible, surfactants are fatty alcohol polyglycol ether sulfates, monoglyceride sulfates, mono- and/or dialkyl sulfosuccinates, fatty acid isethionates, fatty acid sarcosinates, fatty acid taurides, fatty acid glutamates, α-olefinsulfonates, ethercarboxylic acids, alkyl oligoglucosides, fatty acid glucamides, alkylamidobetaines, amphoacetals and/or protein fatty acid condensates, the latter preferably being based on wheat proteins.

The mixing ratio between the nonionic surfactants and the other surfactants is largely unimportant and can vary in the range from 10:90 to 90:10. Preference is given to mixtures of the mixture according to the invention of nonionic surfactants and organic polymer with fatty alcohol sulfates, oxo alcohol sulfates, monoglyceride sulfates, fatty acid isethionates, soaps, olefinsulfonates, acylglutamates, sarcosinates ether-carboxylic acids, and fatty alcohol polyglycol ethers in the weight ratio 70:30 to 30:70 and in particular 60:40 to 40:60.

In a particular embodiment of the invention, the above-described granulation of the aqueous nonionic surfactant/polymer paste is carried out in the presence of a further surfactant paste of fatty alcohol sulfates, betaines, cocomonoglyceride sulfates, acyl glutamates, ester quats or mixtures thereof, with simultaneous drying.

In a further embodiment of the invention, the granulation of the aqueous nonionic surfactant/polymer paste takes place initially as described above with simultaneous drying to give the surfactant granulates; these surfactant granulates are then passed back to the fluidized bed again as nucleic material and granulated in the presence of a further surfactant paste of fatty alcohol sulfate, betaine, cocomonoglyceride sulfate, acylglutamate and/or mixtures thereof a second time and simultaneously dried.

INDUSTRIAL APPLICABILITY

The agents according to the invention can be used in surface-active preparations, such as, for example, cosmetic and/or pharmaceutical preparations, including hair shampoos, hair lotions, foam baths, shower preparations, oral and tooth care compositions, creams, gels, lotions, alcoholic and aqueous/alcoholic solutions, emulsions, wax/fatty compositions, stick preparations, powders or ointments, cleaning compositions, preferably laundry detergents, dishwashing detergents, cleaners and softeners, and also preparations for the treatment of textiles, preferably ironing aids and the like.

The surfactant granulates according to the invention, preferably sugar surfactant granulates, are flowable, do not form lumps and dissolve readily in cold water. They are therefore suitable, for example, for the production of powder detergents and in particular for the production of detergents in piece form, such as detergent tablets, where the granulates are preferably added to the tower powders and, for example in the case of detergent tablets, this powder mixture is then compressed to give the tablets.

The invention therefore provides for the use of the surfactant granulates according to the invention in surface-active preparations, preferably cosmetic and/or pharmaceutical preparations and laundry detergents and cleaners and, in particular, solid pulverulent or piece-form laundry detergents and cleaners, preferably in tablet form.

The surface-active preparations can also comprise, as further additives, mild surfactants, oil components, emulsifiers, superfatting agents, pearlescent waxes, bodying agents, thickeners, polymers, silicone compounds, fats, waxes, stabilizers, biogenic active ingredients, deodorant active ingredients, antidandruff agents, film formers, swelling agents, further UV light protection factors, antioxidants, hydrotropic agents, preservatives, insect repellents, self-tanning agents, solubilizers, perfume oils, dyes, antimicrobial agents and the like.

Typical examples of suitable mild, i.e. particularly skin compatible, surfactants are fatty alcohol polyglycol ether sulfates, monoglyceride sulfates, mono- and/or dialkyl sulfosuccinates, fatty acid isethionates, fatty acid sarcosinates, fatty acid taurides, fatty acid glutamates, α-olefinsulfonates, ether carboxylic acids, alkyl oligoglucosides, fatty acid glucamides, cocamidopropylbetaine, alkylamidobetaines cocamidosulfobetaines and/or protein fatty acid condensates, the latter preferably being based on wheat proteins.

Suitable oil components of the required polarity are, in particular, Guerbet alcohols based on fatty alcohols having 6 to 18, preferably 8 to 10, carbon atoms, esters of branched $C_6$–$C_{13}$-carboxylic acids with linear $C_6$–$C_{22}$-fatty alcohols, esters of linear $C_6$–$C_{22}$-fatty acids with branched alcohols, in particular 2-ethylhexanol, esters of hydroxycarboxylic acids with linear or branched $C_6$–$C_{22}$-fatty alcohols, in particular dioctyl malate, esters of linear and/or branched fatty acids with polyhydric alcohols (such as, for example, propylene glycol, dimerdiol or trimertriol) and/or Guerbet alcohols, liquid mono-/di-/triglyceride mixtures based on $C_6$–$C_{18}$-fatty acids, esters of $C_6$–$C_{22}$-fatty alcohols and/or Guerbet alcohols with aromatic carboxylic acids, in particular benzoic acid, esters of $C_2$–$C_{12}$-dicarboxylic acids with linear or branched alcohols having 1 to 22 carbon atoms or polyols having 2 to 10 carbon atoms and 2 to 6 hydroxyl groups, branched primary alcohols, substituted cyclohexanes, linear and branched $C_6$–$C_{22}$-fatty alcohol carbonates, Guerbet carbonates, esters of benzoic acid with linear and/or branched $C_6$–$C_{22}$-alcohols (e.g. Finsolv® TN), linear or branched, symmetrical or asymmetrical dialkyl ethers having 6 to 22 carbon atoms per alkyl group, ring-opening products of epoxidized fatty acid esters with polyols.

Superfatting agents which can be used are substances such as, for example, lanolin and lecithin, and polyethoxylated or acylated lanolin and lecithin derivatives, polyol fatty acid esters, monoglycerides and fatty acid alkanolamides, the latter also serving as foam stabilizers;

Suitable pearlescent waxes are, for example: alkylene glycol esters, specifically ethylene glycol distearate; fatty acid alkanolamides, specifically coconut fatty acid diethanolamide; partial glycerides, specifically stearic acid monoglyceride; esters of polyhydric, optionally hydroxy-substituted carboxylic acids with fatty alcohols having 6 to 22 carbon atoms, specifically long-chain esters of tartaric acid; fatty substances, such as, for example, fatty alcohols, fatty ketones, fatty aldehydes, fatty ethers and fatty carbonates which have at least 24 carbon atoms in total, specifically laurone and distearyl ether; fatty acids, such as stearic acid, hydroxystearic acid or behenic acid, ring-opening products of olefin epoxides having 12 to 22 carbon atoms with fatty alcohols having 12 to 22 carbon atoms and/or polyols having 2 to 15 carbon atoms and 2 to 10 hydroxyl groups, and mixtures thereof.

Suitable bodying agents are primarily fatty alcohols or hydroxy fatty alcohols having 12 to 22, and preferably 16 to 18 carbon atoms, and also partial glycerides, fatty acids or hydroxy fatty acids. Preference is given to a combination of these substances with alkyl oligoglucosides and/or fatty acid N-methylglucamides of identical chain length and/or polyglycerol poly-12-hydroxystearates.

Suitable thickeners are, for example, Aerosil grades (hydrophilic silicas), polysaccharides, in particular xanthan gum, guar guar, agar agar, alginates and Tyloses, carboxymethylcellulose and hydroxyethylcellulose, and also relatively high molecular weight polyethylene glycol mono- and diesters of fatty acids, polyacrylates, (e.g. Carbopols® from Goodrich or Synthalens® from Sigma), polyacrylamides, polyvinyl alcohol and polyvinylpyrrolidone, surfactants, such as, for example, ethoxylated fatty acid glycerides, esters of fatty acids with polyols, such as, for example, pentaerythritol or trimethylolpropane, fatty alcohol ethoxylates with narrowed homolog distribution or alkyl oligoglucosides, and electrolytes such as sodium chloride and ammonium chloride.

Suitable silicone compounds are, for example, dimethylpolysiloxanes, methylphenylpolysiloxanes, cyclic silicones, and amino-, fatty acid-, alcohol-, polyether-, epoxy-, fluoro-, glucoside- and/or alkyl-modified silicone compounds which can either be liquid or in resin form at room temperature. Also suitable are simethicones, which are mixtures of dimethicones having an average chain length of from 200 to 300 dimethylsiloxane units and hydrogenated silicates. A detailed review of suitable volatile silicones can also be found in Todd et al. in Cosm. Toil. 91, 27 (1976).

Typical examples of fats are glycerides, and suitable waxes are, inter alia, beeswax, carnauba wax, candelilla wax, montan wax, paraffin wax, hydrogenated castor oils, fatty acid esters solid at room temperature or microcrystalline waxes optionally in combination with hydrophilic waxes, e.g. cetylstearyl alcohol or partial glycerides.

Stabilizers which can be used are metal salts of fatty acids, such as, for example, magnesium, aluminum and/or zinc stearate or ricinoleate.

Biogenic active ingredients are to be understood as meaning, for example, tocopherol, tocopherol acetate, tocopherol palmitate, ascorbic acid, deoxyribonucleic acid, retinol, bisabolol, allantoin, phytantriol, panthenol, AHAS, amino acids, ceramides, psuedo-ceramides, essential oils, plant extracts and vitamin complexes.

Suitable deodorant active ingredients are, for example, antiperspirants, such as, for example, aluminum chlorohydrates. These are colorless, hygroscopic crystals which readily deliquesce in air and produce aqueous aluminum chloride solutions upon evaporation. Aluminum chlorohydrate is used for the preparation of antiperspirant and deodorizing preparations and probably acts via the partial closure of the sweat glands by protein and/or polysaccharide precipitation [cf. J. Soc. Cosm. Chem. 24, 281 (1973)]. For example, an aluminum chlorohydrate is available commercially under the name Locron® from Hoechst AG, Frankfurt/FRG, which corresponds to the formula $[Al_2(OH)_5Cl]*2.5H_2O$ and its use is particularly preferred [cf. J. Pharm. Pharmacol. 26, 531 (1975)]. In addition to the chlorohydrates, it is also possible to use aluminum hydroxylactates and acidic aluminum/zirconium salts. Other deodorant active ingredients which may be added are esterase inhibitors. These are preferably trialkyl citrates, such as trimethyl citrate, tripropyl citrate, triisopropyl citrate, tributyl citrate and in particular triethyl citrate (Hydagen® CAT, Henkel KGaA, Disseldorf/FRG). The substances inhibit enzyme activity, thus reducing the formation of odor. Presumably, in this process, the cleavage of the citric ester results in the release of the free acid, which lowers the pH on the skin sufficiently for the enzymes to be inhibited. Other substances which are suitable as esterase inhibitors are sterol sulfates or phosphates, such as, for example, lanosterol, cholesterol, campesterol, stigmasterol and sitostearol sulfate and phosphate, dicarboxylic acids and esters thereof, such as, for example, glutaric acid, monoethyl glutarate, diethyl glutarate, adipic acid, monoethyl adipate, diethyl adipate, malonic acid and diethyl malonate, hydroxy carboxylic acids and esters thereof, such as, for example, citric acid, malic acid, tartaric acid or diethyl tartrate. Antibacterial active ingredients which influence the bacterial flora and destroy bacteria which decompose perspiration or inhibit them in their growth, can likewise be present in the stick preparations. Examples thereof are chitosan, phenoxyethanol and chlorhexidine gluconate. 5-Chloro-2-(2,4-dichlorophenoxy)phenol, which is sold under the trade name Irgasan® by Ciba-Geigy, Basle/CH, has also proven particularly effective.

Antidandruff agents which can be used are climbazole, octopirox and zinc pyrethione. Customary film formers are, for example, chitosan, microcrystalline chitosan, quaternized chitosan, polyvinylpyrrolidone, vinyl-pyrrolidone-vinyl acetate copolymers, polymers of the acrylic acid series, quaternary cellulose derivatives, collagen, hyaluronic acid and salts thereof and similar compounds.

Possible swelling agents for aqueous phases are montmorillonites, clay mineral substances, Pemulen, and alkyl-modified Carbopol grades (Goodrich). Further suitable polymers and swelling agents are given in the overview by R. Lochhead in Cosm. Toil. 108, 95 (1993).

UV light protection factors are to be understood as meaning, for example, organic substances (light protection filters) which are in liquid or crystalline form at room temperature and which are able to absorb ultraviolet radiation and give off the absorbed energy again in the form of longer-wave radiation, e.g. heat. UVB filters can be oil-soluble or water-soluble. Examples of oil-soluble substances are:

- 4-aminobenzoic acid derivatives, preferably 2-ethylhexyl 4-(dimethylamino)benzoate, 2-octyl 4-(dimethylamino) benzoate and amyl 4-(dimethylamino)-benzoate;
- esters of salicylic acid, preferably 2-ethylhexyl salicylate, 4-isopropylbenzyl salicylate, homomenthyl salicylate;
- derivatives of benzophenone, preferably 2-hydroxy-4-methoxybenzophenone, 2-hydroxy-4-methoxy-4'-methylbenzophenone, 2,2'-dihydroxy-4-methoxybenzophenone;
- esters of benzalmalonic acid, preferably di-2-ethyl-hexyl 4-methoxybenzmalonate;
- triazine derivatives, such as, for example, 2,4,6-trianilino(p-carbo-2'-ethyl-1'-hexyloxy)-1,3,5-triazine and octyl triazone, as described in EP 0818450 A1;
- propane-1,3-diones, such as, for example, 1-(4-tert-butylphenyl)-3-(4'-methoxyphenyl)propane-1,3-dione;
- ketotricyclo(5.2.1.0)decane derivatives, as described in BP 0694521 B1.

Suitable water-soluble substances are:

- 2-phenylbenzimidazole-s-sulfonic acid and the alkali metal, alkaline earth metal, ammonium, alkylammonium, alkanolammonium and glucammonium salts thereof;
- sulfonic acid derivatives of benzophenones, preferably 2-hydroxy-4-methoxybenzophenone-5-sulfonic acid and its salts;

sulfonic acid derivatives of 3-benzylidenecamphor, such as, for example, 4-(2-oxo-3-bornylidene-methyl) benzenesulfonic acid and 2-methyl-S-(2-oxo-3-bornylidene)sulfonic acid and salts thereof.

In addition to the two abovementioned groups of primary light protection substances, it is also possible to use secondary light protection agents of the antioxidant type which interrupt the photochemical reaction chain which is triggered when UV radiation penetrates the skin. Typical examples thereof are amino acids (e.g. glycine, histidine, tyrosine, tryptophan) and derivatives thereof, imidazoles (e.g. urocanic acid) and derivatives thereof, peptides, such as D,L-carnosine, D-carnosine, L-carnosine and derivatives thereof (e.g. anserine), carotenoids, carotenes (e.g. α-carotene, β-carotene, lycopene) and derivatives thereof, chlorogenic acid and derivatives thereof, lipoic acid and derivatives thereof (e.g. dihydrolipoic acid), aurothioglucose, propylthiouracil and other thiols (e.g. thioredoxine, glutathione, cysteine, cystine, cystamine and the glycosyl, N-acetyl, methyl, ethyl, propyl, amyl, butyl and lauryl, palmitoyl, oleyl, γ-linoleyl, cholesteryl and glyceryl esters thereof) and salts thereof, dilauryl thiodipropionate, distearyl thiodipropionate, thiodipropionic acid and derivatives thereof (esters, ethers, peptides, lipids, nucleotides, nucleosides and salts) and sulfoximine compounds (e.g. buthioninesulfoximines, homocysteinesulfoximine, buthioninesulfones, penta-, hexa-, heptathioninesulfoximine) in very low tolerated doses (e.g. pmol to μmol/kg), and also (metal) chelating agents (e.g. α-hydroxy fatty acids, palmitic acid, phytic acid, lactoferrin), α-hydroxy acids (e.g. citric acid, lactic acid, malic acid), humic acid, bile acid, bile extracts, bilirubin, biliverdin, EDTA, EGTA and derivatives thereof, unsaturated fatty acids and derivatives thereof (e.g. γ-linolenic acid, linoleic acid, oleic acid), folic acid and derivatives thereof, ubiquinone and ubiquinol and derivatives thereof, vitamin C and derivatives (e.g. ascorbyl palmitate, Mg ascorbyl phosphate, ascorbyl acetate), tocopherols and derivatives (e.g. vitamin E acetate), vitamin A and derivatives (vitamin A palmitate), and coniferyl benzoate of benzoin resin, rutinic acid and derivatives thereof, α-glycosylrutin, ferulic acid, furfurylideneglucitol, carnosine, butylhydroxytoluene, butylhydroxyanisole, nordihydroguaiacic acid, nordihydroguaiaretic acid, trihydroxybutyrophenone, uric acid and derivatives thereof, mannose and derivatives thereof, superoxide dismutase, zinc and derivatives thereof (e.g. ZnO, $ZnSO_4$), selenium and derivatives thereof (e.g. selenomethionine), stilbenes and derivatives thereof (e.g. stilbene oxide, trans-stilbene oxide) and derivatives (salts, esters, ethers, sugars, nucleotides, nucleosides, peptides and lipids) of said active ingredients which are suitable according to the invention.

To improve the flow behavior, it is also possible to use hydrotropic agents, such as, for example, ethanol, isopropyl alcohol or polyols. Polyols which are suitable here preferably have 2 to 15 carbon atoms and at least two hydroxyl groups. The polyols can also contain further functional groups, in particular amino groups, or be modified with nitrogen. Typical examples are:

glycerol;

alkylene glycols, such as, for example, ethylene glycol, diethylene glycol, propylene glycol, butylene glycol, hexylene glycol, and polyethylene glycols with an average molecular weight of from 100 to 1000 daltons;

technical-grade oligoglyceryl mixtures with an intrinsic degree of condensation of from 1.5 to 10, such as, for example, technical-grade diglyceryl mixtures with a diglyceryl content of from 40 to 50% by weight;

methylol compounds, such as, in particular, trimethylolethane, trimethylolpropane, trimethylolbutane, pentaerythritol and dipentaerythritol;

lower alkyl glucosides, in particular those having 1 to 8 carbon atoms in the alkyl radical, such as, for example, methyl and butyl glucoside;

sugar alcohols having 5 to 12 carbon atoms, such as, for example, sorbitol or mannitol, sugars having 5 to 12 carbon atoms, such as, for example, glucose or sucrose;

amino sugars, such as, for example, glucamine;

dialcohol amines, such as diethanolamine or 2-amino-1,3-propanediol.

Suitable preservatives are, for example, phenoxyethanol, formaldehyde solution, parabens, petanediol or sorbic acid and the other classes of substance listed in Appendix 6, Part A and B of the Cosmetics Directive. Suitable insect repellents are N,N-diethyl-m-toluamide, 1,2-pentanediol or Insect Repellent 3535, and a suitable self-tanning agent is dihydroxyacetone.

Perfume oils which may be mentioned are mixtures of natural and synthetic fragrances. Natural fragrances are extracts from flowers (lily, lavender, rose, jasmine, neroli, ylang—ylang), stems and leaves (geranium, patchouli, petitgrain), fruits (aniseed, coriander, cumin, juniper), fruit peels (bergamot, lemon, orange), roots (mace, angelica, celery, cardamom, costus, iris, calmus), woods (pine wood, sandalwood, guaiac wood, cedarwood, rosewood), herbs and grasses (tarragon, lemongrass, sage, thyme), needles and branches (spruce, fir, pine, dwarf-pine), resins and balsams (galbanum, elemi, benzoin, myrrh, olibanum, opoponax). Also suitable are animal raw materials, such as, for example, civet and castoreum. Typical synthetic fragrance compounds are products of the ester, ether, aldehyde, ketone, alcohol and hydrocarbon type. Fragrance compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethylmethylphenyl glycinate, allyl cyclohexylpropionate, styrallyl propionate and benzyl salicylate. The ethers include, for example, benzyl ethyl ether, the aldehydes include, for example, the linear alkanals having 8 to 18 carbon atoms, citral, citronellal, citronellyloxyacetaldehyde, cyclamen aldehyde, hydroxycitronellalii, lilial and bourgeonal, and the ketones include, for example, the ionones, α-isomethylionone and methyl cedryl ketone, the alcohols include anethole, citronellol, eugenol, isoeugenol, geraniol, linalool, phenylethyl alcohol and terpineol, and the hydrocarbons include predominantly the terpenes and balsams. Preference is, however, given to using mixtures of different fragrances which together produce a pleasing fragrance note. Essential oils of relatively low volatility, which are mostly used as aroma components, are also suitable as perfume oils, e.g. sage oil, camomile oil, oil of cloves, melissa oil, mint oil, cinnamon leaf oil, linden blossom oil, juniperberry oil, vetiver oil, olibanum oil, galbanum oil, labolanum oil and lavandin oil. Preference is given to using bergamot oil, dihydromyrcenol, lilial, lyral, citronellol, phenylethyl alcohol, α-hexylcinnamaldehyde, geraniol, benzylacetone, cyclamen aldehyde, linalool, boisambrene forte, ambroxan, indole, hedione, sandelice, lemon oil, mandarin oil, orange oil, allyl amyl glycolate, cyclovertal, lavandin oil, muscatel sage oil, β-damascone, geranium oil bourbon, cyclohexyl salicylate, Vertofix coeur, iso-E-Super, Fixolide NP, evernyl, iraldein gamma, phenylacetic acid, geranyl acetate, benzyl acetate, rose oxide, romilat, irotyl and floramat alone or in mixtures.

Dyes which can be used are the substances which are approved and suitable for cosmetic purposes, as are listed, for example, in the publication "RKomtische Fairbemittel" [Cosmetic Colorants] from the Farbstoffkommission der Deutschen Forschungsgemeinschaft [Dyes Conmission of the German Research Council], Verlag Chemie, Weinheim, 1984, pp. 81–106. These dyes are normally used in concentrations of from 0.001 to 0.1% by weight, based on the total mixture.

Typical examples of antimicrobial agents are preservatives with specific action against Gram-positive bacteria, such as, for example, 2,4,4'-trichloro-2'-hydroxydiphenyl ether, chlorhexidine (1,6-di-(4-chlorophenylbiguanido) hexane) or TCC (3,4,4'-trichlorocarbanilide). Numerous fragrances and essential oils also have antimicrobial properties. Typical examples are the active ingredients eugenol, menthol and thymol in oil of cloves, mint oil and thyme oil. An interesting natural deodorant is the terpene alcohol farnesol (3,7,11-trimethyl-2,6,10-dodecatrien-1-ol), which is present in linden blossom oil and has a lily of the valley odor. Glycerol monolaurate has also proven useful as a bacteriostat. The proportion of additional antibacterial agents is usually about 0.1 to 2% by weight, based on the on the solids content of the preparations.

Powder Detergents

In addition to the specified ingredients, the detergents and cleaners can also comprise further typical ingredients, such as, for example, builders, bleaches, bleach activators, detergency boosters, enzymes, enzyme stabilizers, antiredeposition agents, optical brighteners, soil repellents, foam inhibitors, inorganic salts and fragrances and dyes.

As solid builders, use is made in particular of finely crystalline, synthetic zeolite containing bound water, such as zeolite NaA in laundry detergent grade. Also suitable, however, are zeolite NaX and mixtures of NaA and NaX. The zeolite can be used in the form of spray-dried powder or else as undried (still wet from its preparation) stabilized suspension. Where the zeolite is used in suspension form, said suspension may contain small additions of nonionic surfactants as stabilizers, for example 1 to 3% by weight, based on zeolite, of ethoxylated $C_{12}$–$C_{18}$-fatty alcohols having 2 to 5 ethylene oxide groups or ethoxylated isotridecanols. Suitable zeolites have an average particle size of less than 10 $\mu$m (volume distribution; measurement method; Coulter counter) and contain preferably 18 to 22% by weight, in particular 20 to 22% by weight, of bound water. Suitable substitutes or partial substitutes for zeolites are crystalline, layered sodium silicates of the general formula $NaMSi_xO_{2x+1}.yH_2O$, where M is sodium or hydrogen, x is a number from 1.9 to 4 and y is a number from 0 to 20, and preferred values for x are 2, 3 or 4. Such crystalline phyllosilicates are described, for example, in European patent application EP 0164514 A. Preferred crystalline phyllosilicates are those in which M in the general formula is sodium and x assumes the values 2 or 3. In particular, both β- and γ-sodium disilicates $Na_2Si_2O_5.yH_2O$ are preferred, β-sodium disilicate being obtained, for example, by the process described in international patent application WO 91/08171. The powder detergents according to the invention comprise, as solid builders, preferably 10 to 60% by weight of zeolite and/or crystalline phyllosilicates, where mixtures of zeolite and crystalline phyllosilicates in any desired ratio may be particularly advantageous. In particular, it is preferred for the composition to contain 20 to 50% by weight of zeolite and/or crystalline phyllosilicates. Particularly preferred compositions comprise up to 40% by weight of zeolite and in particular up to 35% by weight of zeolite, in each case based on anhydrous active substance. Further suitable ingredients of the compositions are water-soluble amorphous silicates; preferably, they are used in combination with zeolite and/or crystalline phyllosilicates. Particular preference is given here to compositions containing, in particular, sodium silicate with an $Na_2O:SiO_2$ molar ratio (modulus) of from 1:1 to 1:4.5, preferably from 1:2 to 1:3.5. The amount of amorphous sodium silicates in the compositions is preferably up to 15% by weight and preferably between 2 and 8% by weight. Phosphates, such as tripolyphosphates, pyrophosphates and orthophosphates, may also be present in the compositions in small amounts. The phosphate content of the compositions is preferably up to 15% by weight, but in particular from 0 to 10% by weight. Moreover, the compositions may also comprise, additionally, phyllosilicates of natural and synthetic origin. Such phyllosilicates are known, for example, from the patent applications DE 2334899 B, HP 0026529 A and DE 3526405 A. Their usefulness is not restricted to a specific composition or structural formula. However, preference is given here to smectites, in particular bentonites. Suitable phyllosilicates which belong to the group of the water-swellable smectites include, for example, those of the general formulae $(OH)_4Si_{8-y}Al_y(Mg_xAl_{4-x})O_{20}$ montmorillonite $(OH)_4Si_{8-y}Al_y(Mg_{6-z}Li_x)O_{20}$ hectorite $(OH)_4Si_{8-y}Al_y(Mg_{6-z}Al_z)O_{20}$ saponite where x=0 to 4, y=0 to 2, z=0 to 6. In addition, small amounts of iron may be incorporated into the crystal lattice of the phyllosilicates in accordance with the above formulae. In addition, on the basis of their ion-exchanging properties, the phyllosilicates may contain hydrogen, alkali metal, alkaline earth metal ions, in particular Nag and $Ca^{2+}$. The amount of water of hydration is in most cases in the range from 8 to 20% by weight and is dependent on the state of swelling and/or on the nature of processing. Phyllosilicates which can be used are known, for example, from U.S. Pat. No. 3,966,629, U.S. Pat. No. 4,062,647, BP 0026529 A and EP 0028432 A. It is preferred to use phyllo-silicates which, owing to an alkali treatment, are largely free from calcium ions and strongly coloring iron ions. Useful organic builder substances are, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), provided such a use is not objectionable on environmental grounds, and mixtures thereof. Preferred salts are the salts of the polycarboxylic acids such as citric acid, adipic acid, succinic acid, glutaric acid, tartaric acid, sugar acids and mixtures thereof. Suitable polymeric polycarboxylates are, for example, the sodium salts of polyacrylic acid or of polymethacrylic acid, for example those having a relative molecular mass of from 800 to 150 000 (based on acid). Particularly suitable copolymeric polycarboxylates are those of acrylic acid with methacrylic acid and of acrylic and methacrylic acid with maleic acid. Copolymers of acrylic acid with maleic acid which contain 50 to 90% by weight of acrylic acid and 50 to 10% by weight of maleic acid have proven particularly suitable. Their relative molecular mass, based on free acids, is generally 5000 to 200 000, preferably 10 000 to 120 000 and in particular 50 000 to 100 000. The use of polymeric polycarboxylates is not obligatory. If, however, polymeric polycarboxylates are used, then preference is given to compositions which comprise biodegradable polymers, examples being terpolymers whose monomers are acrylic acid and maleic acid and/or salts thereof and also vinyl alcohol and/or vinyl alcohol derivatives or whose monomers are acrylic acid and 2-alkylallylsulfonic acid and/or salts thereof, and also sugar derivatives. Particular preference is given to terpolymers obtained in accordance with the teachings of German patent applications DE 4221381 A and DE 4300772 A. Further suitable builder substances are polyacetals which may be obtained by reacting dialdehydes with polyolcarboxylic acids which have 5 to 7 carbon atoms and at least 3 hydroxyl groups, as described for example in European patent application HP 0280223 A. Preferred polyacetals are obtained from dialdehydes such as glyoxal, glutaraldehyde, terephthalaldehyde, and mixtures thereof and from polyolcarboxylic acids, such as gluconic acid and/or glucoheptonic acid.

Among the compounds which produce hydrogen peroxide in water and serve as bleaches, sodium perborate tetrahydrate and sodium perborate monohydrate are of particular importance. Further bleaches are, for example, peroxycarbonate, citrate perhydrates and salts of peracids, such as perbenzoates, peroxyphthalates or diperoxydodecanedioic acid. They are usually used in amounts of from 8 to 25% by weight. Preference is given to the use of sodium perborate monohydrate in amounts of from 10 to 20% by weight and in particular from 10 to 15% by weight. As a result of its ability to be able to bond free water to form the tetrahydrate, it contributes to increasing the stability of the composition.

In order to achieve an improved bleaching action during washing at temperatures of 60° C. and below, bleach activators can be incorporated into the preparations. Examples thereof are N-acyl or O-acyl compounds which form organic peracids with hydrogen peroxide, preferably N,N'-tetraacylated diamines, and also carboxylic anhydrides and esters of polyols, such as glucose pentaacetate. The content of bleach activators in the bleach-containing compositions is in the customary range, preferably between 1 and 10% by weight and in particular between 3 and 8% by weight.

Particularly preferred bleach activators are N,N,N',N'-tetraacetylethylenediamine and 1,5-diacetyl-2,4-dioxohexahydro-1,3,5-triazine.

Suitable enzymes are those from the class of proteases, lipases, amylases, cellulases and mixtures thereof. Enzymatic active ingredients obtained from bacterial strains or fungi, such as *Bacillus subtilis, Bacillus licheniformis* and *Streptomyces griseus* are particularly suitable. Preference is given to using proteases of the subtilisin type and in particular proteases which are obtained from *Bacillus lentus*. Their proportion can be about 0.2 to about 2% by weight. The enzymes can be adsorbed to carrier substances and/or be embedded into coating substances in order to protect them against premature decomposition. In addition to the mono- and polyfunctional alcohols and the phosphates, the compositions can comprise further enzyme stabilizers. For example, 0.5 to 1% by weight of sodium formate can be used. Also possible is the use of proteases which have been stabilized with soluble calcium salts and a calcium content of, preferably, about 1.2% by weight, based on the enzyme. However, the use of boron compounds, for example of boric acid, boric oxide, borax and other alkali metal borates, such as the salts of orthoboric acid ($H_3BO_3$), of metaboric acid ($HBO_2$) and of pyroboric acid (tetraboric acid $H_2B_4O_7$) is particularly advantageous.

Antiredeposition agents have the task of keeping the soil detached from the fibers suspended in the liquor, thus preventing graying. Suitable for this purpose are water-soluble colloids, mostly organic in nature, for example the water-soluble salts of polymeric carboxylic acids, glue, gelatin, salts of ethercarboxylic acids or ethersulfonic acids of starch or of cellulose or salts of acidic sulfuric esters of cellulose or of starch. Water-soluble polyamides which contain acidic groups are also suitable for this purpose. In addition, it is also possible to use soluble starch preparations, and starch products other than those mentioned above, e.g. degraded starch, aldehyde starches etc. It is also possible to use polyvinylpyrrolidone. Preference is, however, given to cellulose ethers, such as carboxymethylcellulose, methylcellulose, hydroxyalkylcellulose and mixed ethers, such as methylhydroxyethylcellulose, methylhydroxypropylcellulose, methylcarboxymethylcellulose and mixtures thereof, and polyvinylpyrrolidone, for example in amounts of from 0.1 to 5% by weight, based on the compositions.

As optical brighteners, the compositions can comprise derivatives of diaminostilbenedisulfonic acid and alkali metal salts thereof. For example, salts of 4,4'-bis(2-anilino-4-morpholino-1,3,5-triazinyl-6-amino)stilbene-2,21-disulfonic acid or compounds constructed in a similar way which carry a diethanolamino group, a methylamino group, an anilino group or a 2-methoxyethylamino group instead of the morphilino group are suitable. Brighteners of the substituted diphenylstyryl type may also be present, e.g. the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the abovementioned brighteners may also be used. Uniformly white granulates are obtained if the compositions comprise, in addition to the customary brighteners in customary amounts, for example between 0.1 and 0.5% by weight, preferably between 0.1 and 0.3% by weight, also small amounts, for example $10^{-6}$ to $10^{-3}$% by weight, preferably $10^{-5}$% by weight, of a blue dye. A particularly preferred dye is Tinolux@ (commercial product from. Ciba-Geigy).

Suitable soil-repellent polymers are those which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units is in particular in the range from 750 to 5000, i.e. the degree of ethoxylation of the polyethylene glycol group-containing polymers may be about 15 to 100. The polymers are characterized by an average molecular weight of about 5000 to 200 000 and can have, a block structure, but preferably have a random structure. Preferred polymers are those with ethylene terephthalate/polyethylene glycol terephthalate molar ratios of about 65:35 to about 90:10, preferably from about 70:30 to 80:20. Also preferred are those polymers which have linking polyethylene glycol units with a molecular weight of from 750 to 5000, preferably from 1000 to about 3000 and a molecular weight of the polymer from about 10 000 to about 50 000. Examples of commercially available polymers are the products Milease® T (ICI) or Repelotex® SRP 3 (Rhone-Poulenc).

For use in machine washing processes, it may be advantageous to add customary foam inhibitors to the compositions. Suitable for this purpose are, for example, soaps of natural or synthetic origin which have a high proportion of $C_{18}$–$C_{24}$-fatty acids. Suitable non-surfactant-like foam inhibitors are, for example, organopolysiloxanes and mixtures thereof with microfine, optionally silanized silica, and also paraffins, waxes, microcrystalline waxes and mixtures thereof with silanized silica or bistearylethylenediamide. Also used with advantages are mixtures of different foam inhibitors, e.g. those of silicones, paraffins or waxes. The foam inhibitors, in particular foam inhibitors comprising silicone or paraffin, are preferably bound to a granular, water-soluble or water-dispersible carrier substance. In particular, mixtures of paraffins and bistearylethylenediamides are preferred.

The total amount of auxiliaries and additives may be 1 to 50% by weight, preferably 5 to 40% by weight, based on the compositions. The compositions can be prepared by customary cold or hot processes; preference is given to using the phase-inversion temperature method.

EXAMPLES

Example 1

Preparation of a readily soluble APG-SKET granulate. At 50° C., 37.5 kg of a 40% strength aqueous solution of polyacrylate/methacrylate (Sokalan CP 5) were mixed into 170 kg of a 50% strength cocoalkyl oligoglucoside paste (Glucopon® 600 CS UP), the mixture was adjusted to a pH of 7 with citric acid and granulated via a nozzle in fluidized-bed equipment for granulation drying from Glatt and simultaneously dried. About 100 kg of a dust-free and nonsticky granulate with a residual water content of 2% by weight were obtained in a particle size distribution of 0.2–1.6 mm. The product was still flowable even under compressive stress after days. 10 g of the granulate dissolved within 5 minutes in 250 ml of water at a temperature of 20° C.

Comparative Example 1

200 kg of a 50% strength cocoalkyl oligoglucoside paste (Glucopon 600 CS UP) were adjusted to a pH of 7 at 50° C. with citric acid and, without the addition of a 40% aqueous solution of polyacrylate/methacrylate (Sokalan CP 5), granulated via a nozzle in fluidized-bed equipment for granulation drying from Glatt and simultaneously dried. This gave a sticky granulate with a particle size distribution of 0.5–10 mm and a residual water content of 3% by weight which caked together again even upon slight pressure. 10 g of this granulate required more than 30 minutes until it had dissolved completely in 250 ml of water at a temperature of 200° C.

Example 2

Preparation of a readily soluble APG-SKET granulate. At 50° C., 37.5 kg of a 40% strength aqueous solution of polyacrylate/methacrylate (Sokalan CP 5) were mixed into 70 kg of 50% strength cocoalkyl oligoglucoside paste (Glucopon 600 CS UP) and 50 kg of a mixture consisting of 35 kg of cocoalkyl oligoglucoside and 15 kg of C12/14-fatty alcohol, and granulated via a nozzle in equipment for granulation drying from Glatt and simultaneously dried. About 100 kg of a dust-free and non-sticky granulate with a residual water content of 2.5% by weight were obtained in a particle size distribution of 0.2–1.6 mm. The product was still flowable even under compressive stress after days. 10 g of this granulate dissolved within 5 minutes in 250 ml of water at a temperature of 20° C.

Examples 3 to 18

To prepare a readily soluble APG-SKET granulate, the following polymers were used in place of the polyacrylate/methacrylate:

(3) protein hydrolyzate powder (Gluadin WP),
(4) water-soluble wheat gluten,
(5) guarhydroxypropyltrimethylammonium chloride (Cosmedia Guar C 261; Cognis)
(6) polyaspartate (MW 20 000, Donlar)
(7) cyclodextrin
(8) dextrin
(9) carboxymethyldextran
(10) cationically modified cellulose (Polymer JR 400)
(11) polyglycol-polyamine condensation resin (Polyquart H 81; Cognis)
(12) polyhydroxycarboxylic acid, sodium salt powder (Hydagen F. Cognis)
(13) vinylpyrrolidone/vinyl acetate copolymer powder (Nasuna B; Cognis)
(14) guar flour powder (Cosmedia Guar U; Cognis)
(15) chitosan powder (Hydagen HCMF; Cognis)
(16) cationically modified protein hydrolyzate (Gluadin WQ; Cognis)
(17) polybeta-alanine/glutaric acid crosspolymer powder
(18) polyethyl glutamate powder

TABLE 1

| Cosmetic preparations (water, presrevatives ad 100% by weight) | | | | | | | | | | |
|---|---|---|---|---|---|---|---|---|---|---|
| Composition (INCI) | 1 | 2 | 3 | 4 | 5 | 6 | 7 | 8 | 9 | 10 |
| Texapon ® NSO<br>Sodium Laureth Sulfate | — | — | — | — | — | — | 38.0 | 38.0 | 25.0 | — |
| Texapon ® SB3<br>Disodium Laureth Sulfosuccinate | — | — | — | — | — | — | — | — | 10.0 | — |
| Glucopon 600 CS UP Granulate as in Ex. 1<br>Cocco Glucosides | 2.0 | — | — | 2.0 | — | — | 7.0 | 7.0 | 6.0 | 10.0 |
| Glucopon 600 CS UP Granulate as in Ex. 10<br>Coco Glucosides | | 4.0 | | | 4.0 | | | | | |
| Glucopon 600 CS UP Granulate as in Ex. 16<br>Coco Glucosides | | | 4.0 | | | 4.0 | | | | |
| Plantacare ® PS 10<br>Sodium Laureth Sulfate (and) Coco Gluosides | — | — | — | — | — | — | — | — | — | 6.0 |
| Dehyton ® PK 45<br>Cocanthiopropyl Betaine | — | — | — | — | — | — | — | — | 10.0 | — |
| Dehyquart ® A<br>Cetylimmium Chloride | 2.0 | — | — | 2.0 | — | — | — | — | — | — |
| Dehyquart L ® 80<br>Dicocoylmethylethoxymonlium Methosulfate (and) Propylene Glycol | 1.2 | 1.2 | 1.2 | 1.2 | 0.6 | 0.6 | — | — | — | — |
| Eumulgin ® B2<br>Catearth-20 | 0.8 | 0.8 | — | 0.8 | — | 1.0 | — | — | — | — |
| Eumulgin ® VL 75 | — | — | 0.8 | — | 0.8 | — | — | — | — | — |

TABLE 1-continued

| Cosmetic preparations (water, presrevatives ad 100% by weight) | | | | | | | | | | |
|---|---|---|---|---|---|---|---|---|---|---|
| Lauryl Glucoside (and) Polyglyceryl-2 Polyhydroxystearate (and) Glycerol<br>Lanette ® O | 2.5 | 2.5 | 2.5 | 2.5 | 3.0 | 2.5 | — | — | — | — |
| Cetesyl Alcohol<br>Cutina ® GMS | 0.5 | 0.5 | 0.5 | 0.5 | 0.5 | 1.0 | — | — | — | — |
| Glyceryl Stearate<br>Cetiol ® HE | 1.0 | — | — | — | — | — | — | — | 1.0 | |
| PEG-7 Glyceryl Coconate<br>Cetiol ® PGL | — | 1.0 | — | — | 1.0 | — | — | — | — | — |
| Hexyldecanol (and) Hexyldecyl Laurate<br>Cetiol ® V | — | — | — | 1.0 | — | — | — | — | — | — |
| Decyl Oleate<br>Eutanol ® G | — | — | 1.0 | — | — | 1.0 | — | — | — | — |
| Octylthodecanol<br>Nutriflan ® Keratin W | — | — | — | 2.0 | — | — | — | — | — | — |
| Hydrolyzed Keratin<br>Lamesoft ® LMG | — | — | — | — | — | — | 3.0 | 2.0 | 4.0 | — |
| Glyceryl Laurate (and) Potassium Cocoyl Hydrolyzed Collagen<br>Euperfan ® PK 3000 AM | — | — | — | — | — | — | — | 3.0 | 5.0 | 5.0 |
| Glycol Distearate (and) Laureth-4 (and) Cocamidopropyl Betaine<br>Ganerol ® 122 N | — | — | — | — | 1.0 | 1.0 | — | — | — | — |
| Soja Starol<br>Highcareen ® GS | 1.0 | 1.0 | 1.0 | 1.0 | 1.0 | 1.0 | 1.0 | 1.0 | 1.0 | 1.0 |
| Betaglucan<br>Hydragen ® CMF | 1.0 | 1.0 | 1.0 | 1.0 | 1.0 | 1.0 | 1.0 | 1.0 | 1.0 | 1.0 |
| Chitosan<br>Copherol ® 12250 | — | — | 0.1 | 0.1 | — | — | — | — | — | — |
| Tocopherol Acetate<br>Arlypon ® F | — | — | — | — | — | — | 3.0 | 3.0 | 1.0 | — |
| Laureth-2<br>Sodium Chloride | — | — | — | — | — | — | — | 1.5 | — | 1.5 |

| (1–4) hair rinse, (5–6) hair cure, (7–8) shower preparation, (9) shower gel, (10) washing lotion<br>Composition (INCI) | 11 | 12 | 13 | 14 | 15 | 16 | 17 | 18 | 19 | 20 |
|---|---|---|---|---|---|---|---|---|---|---|
| Texapon ® NSO<br>Sodium Laureth Sulfate | 20.0 | 20.0 | 12.4 | — | 25.0 | 11.0 | — | — | — | — |
| Texapon ® K14S<br>Sodium Myreth Sulfate | — | — | — | — | — | — | — | — | 11.0 | 23.0 |
| Texapon ® SB 3<br>Disodium Laureth Sulfosuccinate | — | — | — | — | — | 7.0 | — | — | — | — |
| Glucopon 600 CS UP Granulate as in Ex. 1<br>Caco Glucosides | 5.0 | 5.0 | 4.9 | — | — | — | 10.0 | — | 8.0 | 4.0 |
| Glucopon 600 CS UP Granulate as in Ex. 6<br>Coco Glucosides | | | | 20.0 | | | | 10.8 | | |
| Glucopon 600 CS UP Granulate as in Ex. 8<br>Coco Glucosides | | | | | 5.0 | | | | | |
| Plantacare ® 2000<br>Decyl Glucoside | — | — | — | — | 5.0 | 4.0 | — | — | — | — |
| Plantacare ® PS 10<br>Sodium Laureth Sulfide (and) Coco Glucosides | — | — | — | 20.0 | — | — | 6.0 | 7.0 | — | — |
| Dehyton ® PK 45<br>Cocamidopropyl Betaine | 20.0 | 20.0 | — | — | 8.0 | — | — | — | — | 7.0 |
| Eumulgin ® B1<br>Cetareth-12 | — | — | — | — | 1.0 | — | — | — | — | — |
| Eumulgin ® B2<br>Cetereth-20 | — | — | — | 1.0 | — | — | — | — | — | — |
| Lameform ® TGI<br>Polyglyceryl-3 Isostearate | — | — | — | 4.0 | — | — | — | — | — | — |
| Dehymule ® PGPH<br>Polyglyceryl-2 Dipohydroxystearate | — | — | 1.0 | — | — | — | — | — | — | — |
| Monomuls ® 90-L 12<br>Glyceryl Laurade | — | — | — | — | — | — | — | — | 1.0 | 1.0 |
| Cetiol ® HE<br>PEG-7 Glyceryl Coconate | — | 0.2 | — | — | — | — | — | — | — | — |
| Eutanol ® G<br>Octyldodecanol | — | — | — | 3.0 | — | — | — | — | — | — |
| Nutrilan ® Keratin W<br>Hydrolyzed Keratin | — | — | — | — | — | — | — | — | 2.0 | 2.0 |
| Nutrilan ® I<br>Hydrolyzed Collagen | 1.0 | — | — | — | — | 2.0 | — | 2.0 | — | — |
| Lamesoft ® LMG<br>Glyceryl Laurate (and) Potassium Cocoyl Hydrolyzed Collagen | — | — | — | — | — | — | — | — | 1.0 | — |
| Lamesoft ® 156<br>Hydrogenated Tallow Glycentie (and) Potassium Cocoyl Hydrolyzed Collagen | — | — | — | — | — | — | — | — | — | 5.0 |
| Gluadin ® WK | 1.0 | 1.5 | 4.0 | 1.0 | 3.0 | 1.0 | 2.0 | 2.0 | 2.0 | — |

TABLE 1-continued

| Cosmetic preparations (water, presrevatives ad 100% by weight) | | | | | | | | | | |
|---|---|---|---|---|---|---|---|---|---|---|
| Sodium Cocoyl Hydrolyzed Wheat Protein | | | | | | | | | | |
| Euperlan ® PK 3000 AM | 5.0 | 3.0 | 4.0 | — | — | — | — | 3.0 | 3.0 | — |
| Glycol Distearate (and) Laureth-4 (and) Cocamidopropyl Betaine | | | | | | | | | | |
| Panthenol | — | — | 1.0 | — | — | — | — | — | — | — |
| Arfypon ® F | 2.6 | 1.6 | — | 1.0 | 1.5 | — | — | — | — | — |
| Laureth-2 | | | | | | | | | | |
| Highcareen ® GS | 1.0 | 1.0 | 1.0 | 1.0 | 1.0 | 1.0 | 1.0 | 1.0 | 1.0 | 1.0 |
| Betaglucan | | | | | | | | | | |
| Hydagen ® CMF | 1.0 | 1.0 | 1.0 | 1.0 | 1.0 | 1.0 | 1.0 | 1.0 | 1.0 | 1.0 |
| Chitosen | | | | | | | | | | |
| Sodium Chloride | — | — | — | — | — | 1.8 | 2.0 | 2.2 | — | 3.0 |
| Glycerol (86% strength by weight) | — | 5.0 | — | — | — | — | — | 1.0 | 3.0 | — |
| (11–14) "Two-in-One" shower preparation, (15–20) shampoo | | | | | | | | | | |
| Composition (INCI) | 21 | 22 | 23 | 24 | 25 | 26 | 27 | 28 | 29 | 30 |
| Texapon ® NSO | — | 30.0 | 30.0 | — | 25.0 | — | — | — | — | — |
| Sodium Laureth Sulfate | | | | | | | | | | |
| Glucopon 600 CS UP Granulate as in Ex. 3 | 12.0 | | | | 5.0 | | 7.0 | 8.0 | | |
| Coco Glucosides | | | | | | | | | | |
| Glucopon 600 CS UP Granulate as in Ex. 4 | | | 4.0 | | | 5.0 | | | 6.0 | 4.0 |
| Coco Glucosides | | | | | | | | | | |
| Glucopon 600 CS UP Granulate as in Ex. 6 | — | | — | 12.0 | | — | — | — | — | — |
| Coco Glucosides | | | | | | | | | | |
| Glucopon 600 CS UP Granulate as in Ex. 9 | | 10.0 | | | 20.0 | | | | | |
| Coco Glucosides | | | | | | | | | | |
| Plantacare ® PS 10 | 10.0 | — | 5.0 | 10.0 | — | — | — | — | — | — |
| Sodium Laureth Sulfate (and) Coco Glucosides | | | | | | | | | | |
| Dehyton ® PK 45 | 15.0 | 10.0 | 15.0 | 15.0 | 20.0 | — | — | — | — | — |
| Cocamidopropyl Betaine | | | | | | | | | | |
| Emulgade ® SE | — | — | — | — | — | 5.0 | 5.0 | 4.0 | — | — |
| Glyceryl Stearate (and) Ceteareth 12/20 (and) Cestearyl Alcohol (and) Cetyl Palmitate | | | | | | | | | | |
| Eumulgin ® B1 | — | — | — | — | — | — | — | 1.0 | — | — |
| Caleaureth-12 | | | | | | | | | | |
| Lamaform ® TGI | — | — | — | — | — | — | — | — | 4.0 | — |
| Polyglyceryl-3 Isostearate | | | | | | | | | | |
| Dehymuls ® PGPH | — | — | — | — | — | — | — | — | — | 4.0 |
| Polyglyceryl-2 Dipolyhydroxystearate | | | | | | | | | | |
| Monomuls ® 90-O 18 | — | — | — | — | — | — | — | — | 2.0 | — |
| Glyceryl Oleate | | | | | | | | | | |
| Catfol ® HE | 2.0 | — | — | 2.0 | 5.0 | — | — | — | — | 2.0 |
| PEG-7 Glyceryl Cocamide | | | | | | | | | | |
| Cethol ® OE | — | — | — | — | — | — | — | — | 5.0 | 6.0 |
| Dicaprlyl Ether | | | | | | | | | | |
| Cetiol ® PGL | — | — | — | — | — | — | — | 3.0 | 10.0 | 9.0 |
| Hexyldecanol (and) Hexyldecyl Laurate | | | | | | | | | | |
| Cetlol ® SN | — | — | — | — | — | 3.0 | 3.0 | — | — | — |
| Cetearyl Isononanoate | | | | | | | | | | |
| Cetiol ® V | — | — | — | — | — | 3.0 | 3.0 | — | — | — |
| Decyl Cheate | | | | | | | | | | |
| Myrtrol ® 318 | — | — | — | — | — | — | — | 3.0 | 5.0 | 5.0 |
| Coco Capylate Caprate | | | | | | | | | | |
| Beeswax | — | — | — | — | — | — | — | 7.0 | 5.0 | |
| Nutrillan +00 Elastin E20 | — | — | — | — | — | 2.0 | — | — | — | — |
| Hydrolyzed Elastin | | | | | | | | | | |
| Nutrilan ® I-50 | — | — | — | — | 2.0 | — | 2.0 | — | — | — |
| Hydrolyzed Collagen | | | | | | | | | | |
| Glaudin ® AGP | 0.5 | 0.5 | 0.5 | — | — | — | — | 0.5 | — | — |
| Hydrolyzed Wheat Glutan | | | | | | | | | | |
| Gluadin ® WK | 2.0 | 2.0 | 2.0 | 2.0 | 5.0 | — | — | — | 0.5 | 0.5 |
| Sodium Cocoyl Hydrolyzed Wheat Protein | | | | | | | | | | |
| Euperian ® PK 3000 AM | 5.0 | — | — | 5.0 | — | — | — | — | — | — |
| Glycol Distearate (and) Laureth-4 (and) Cocamidopropyl Betaine | | | | | | | | | | |
| Arfypon ® F | — | — | — | — | — | — | — | — | — | — |
| Laureth-2 | | | | | | | | | | |
| Highcareen ® GS | 1.0 | 1.0 | 1.0 | 1.0 | 1.0 | 1.0 | 1.0 | 1.0 | 1.0 | 1.0 |
| Betaglucan | | | | | | | | | | |
| Hydagan ® CMF | 1.0 | 1.0 | 1.0 | 1.0 | 1.0 | 1.0 | 1.0 | 1.0 | 1.0 | 1.0 |
| Chitosan | | | | | | | | | | |
| Magnesium Sulfate Heptahydrate | — | — | — | — | — | — | — | — | 1.0 | 1.0 |
| Glycerol (86% strength by weight) | — | — | — | — | — | 3.0 | 3.0 | 5.0 | 5.0 | 3.0 |
| (21–25) foam bath, (26) soft cream, (27, 28) moisturizing emulsion, (29, 30) night cream | | | | | | | | | | |
| Composition (INCI) | 31 | 32 | 33 | 34 | 35 | 36 | 37 | 38 | 39 | 40 |
| Dehymuls ® PGPH | 4.0 | 3.0 | — | 5.0 | — | — | — | — | — | — |

TABLE 1-continued

| Cosmetic preparations (water, presrevatives ad 100% by weight) | | | | | | | | | | |
|---|---|---|---|---|---|---|---|---|---|---|
| Polyglyceryl-2 Dicophyhydroxystearate | | | | | | | | | | |
| Lamsfornn ® TGI | 2.0 | 1.0 | — | — | — | — | — | — | — | — |
| Polyglyceryl-3 Disostearate | | | | | | | | | | |
| Emulgade ® PL 68/50 | — | — | — | — | 4.0 | — | — | — | 3.0 | — |
| Cetearyl Glucoside (and) Cetargyl Alcohol | | | | | | | | | | |
| Eumulgin ® B2 | — | — | — | — | — | — | — | 2.0 | — | — |
| Cethareth-20 | | | | | | | | | | |
| Tegocare ® PS | — | — | 3.0 | — | — | — | 4.0 | — | — | — |
| Polyglyceryl-3 Methylglucose Distearate | | | | | | | | | | |
| Glucopon 600 CS UP Granulate as in Ex. 3 | 3.0 | 5.0 | 2.0 | 6.0 | 1.0 | 5.0 | 3.0 | 2.0 | 3.0 | 7.0 |
| Coco Glucosides | | | | | | | | | | |
| Eumulgin VL 75 | — | — | — | — | — | 3.5 | — | — | 2.5 | — |
| Polyglyceryl-2 Dipohydroxystearate (and) Lauryl Glucoside (and) Glycerol | | | | | | | | | | |
| Beeswax | 3.0 | 2.0 | 5.0 | 2.0 | — | — | — | — | — | — |
| Cutina ® GMS | — | — | — | — | — | 2.0 | 4.0 | — | — | 4.0 |
| Glyceryl Stearate | | | | | | | | | | |
| Lanette ® O | — | — | 2.0 | — | 2.0 | 4.0 | 2.0 | 4.0 | 4.0 | 1.0 |
| Cetasyl Alcohol | | | | | | | | | | |
| Antaron ® V 216 | — | — | — | — | — | 3.0 | — | — | — | 2.0 |
| PVP/Hexadecone Copolymer | | | | | | | | | | |
| Myritol ® 818 | 5.0 | — | 10.0 | — | 8.0 | 6.0 | 6.0 | — | 6.0 | 5.0 |
| Cocoglycerides | | | | | | | | | | |
| Finsoly ® TN | — | 6.0 | — | 2.0 | — | — | 3.0 | — | — | 2.0 |
| C12/15 Alkyl Benzoate | | | | | | | | | | |
| Cetiol ® J 600 | 7.0 | 4.0 | 3.0 | 5.0 | 4.0 | 3.0 | 3.0 | — | 5.0 | 4.0 |
| Oleyl Encode | | | | | | | | | | |
| Cetiol ® OE | 3.0 | — | 6.0 | 8.0 | 6.0 | 5.0 | 4.0 | 3.0 | 4.0 | 6.0 |
| Olagryl Ether | | | | | | | | | | |
| Mineral Oil | — | 4.0 | — | 4.0 | — | 2.0 | — | 1.0 | — | — |
| Cetiol ® PGL | — | 7.0 | 3.0 | 7.0 | 4.0 | — | — | — | 1.0 | — |
| Hexadecanol (and) Hexyldecyl Laurate | | | | | | | | | | |
| Panthenol/Bisobolol | 1.2 | 1.2 | 1.2 | 1.2 | 1.2 | 1.2 | 1.2 | 1.2 | 1.2 | 1.2 |
| Highcareen ® GS | 1.0 | 1.0 | 1.0 | 1.0 | 1.0 | 1.0 | 1.0 | 1.0 | 1.0 | 1.0 |
| Betaglucan | | | | | | | | | | |
| Hydagen ® CMF | 1.0 | 1.0 | 1.0 | 1.0 | 1.0 | 1.0 | 1.0 | 1.0 | 1.0 | 1.0 |
| Chilossa | | | | | | | | | | |
| Copherol ® F 1300 | 0.5 | 1.0 | 1.0 | 2.0 | 1.0 | 1.0 | 1.0 | 2.0 | 0.5 | 2.0 |
| Tocopherol/Tocophenyl Acetate | | | | | | | | | | |
| Neo Hallopan ® Hydro | 3.0 | — | — | 3.0 | — | — | 2.0 | — | 2.0 | — |
| Sodium Phenylbenzimidazole Sulfonate | | | | | | | | | | |
| Neo Hellopan ® 303 | — | 5.0 | — | — | — | 4.0 | 5.0 | — | — | 10.0 |
| Octocylene | | | | | | | | | | |
| Neo Hallopan ® BB | 1.5 | — | — | 2.0 | 1.5 | — | — | — | 2.0 | — |
| Benzophanone-3 | | | | | | | | | | |
| Neo Hallopen ® E 1000 | 5.0 | — | 4.0 | — | 2.0 | 2.0 | 4.0 | 10.0 | — | — |
| Isoamyl p-Methoxydraphate | | | | | | | | | | |
| Neo Hellopan ® AV | 4.0 | — | 4.0 | 3.0 | 2.0 | 3.0 | 4.0 | — | 10.0 | 2.0 |
| Octyl Methoxycinnamate | | | | | | | | | | |
| Uvlaul ® T 150 | 2.0 | 4.0 | 3.0 | 1.0 | 1.0 | 1.0 | 4.0 | 3.0 | 3.0 | 3.0 |
| Octyl Triazone | | | | | | | | | | |
| Zinc Oxide | — | 6.0 | 6.0 | — | 4.0 | — | — | — | — | 5.0 |
| Titanium Dioxide | — | — | — | — | — | — | — | 5.0 | — | — |
| Glycerol (86% strength by weight) | 5.0 | 5.0 | 5.0 | 5.0 | 5.0 | 5.0 | 5.0 | 5.0 | 5.0 | 5.0 |

(31) W/O sunscreen cream, (32–34) W/O sunscreen lotion, (35,38, 40) O/W sunscreen lotion (36, 37, 39) O/W sunscreen cream

TABLE 2

| Detergent preparations (water, preservatives ad 100% by weight) | | | | | | | | | | |
|---|---|---|---|---|---|---|---|---|---|---|
| Composition (INCI) | 1 | 2 | 3 | 4 | 5 | 6 | 7 | 8 | 9 | 10 |
| Glucopon 600 CS UP Granulate as in Ex. 2 | 4.0 | 5.0 | 11.0 | 15.0 | 6.0 | 19.5 | 5.0 | 7.0 | 10.0 | 5.0 |
| Coco Glucosides | | | | | | | | | | |
| Maranil ® Paste A 55 | — | 23.6 | — | 19.0 | — | — | 11.0 | 7.0 | — | — |
| Dodecylbenzenesulfonate, Sodium Salt | | | | | | | | | | |
| Sulfopon ® 1218 W | 5.5 | — | 14.5 | — | — | — | — | 3.0 | 12.0 | 35.0 |
| Laurylstearyl Sulfate, Sodium Salt | | | | | | | | | | |
| Texapon ® N | — | — | — | — | — | 9.6 | — | — | — | — |
| Lauryl Alcohol + 2EO Sulfate, Sodium Salt | | | | | | | | | | |
| Dehyquart ® AU 56 | — | — | — | — | 6.7 | — | — | — | — | — |
| Methyl-quaternized Diplan Fatty Acid Triethanolammonium Ester, Methosulfate | | | | | | | | | | |
| Comperfan ® 100 | — | — | — | — | — | — | — | — | — | 10.0 |

TABLE 2-continued

| Detergent preparations (water, preservatives ad 100% by weight) | | | | | | | | | | |
|---|---|---|---|---|---|---|---|---|---|---|
| Coco Fatty Acid Ethanolamide | | | | | | | | | | |
| Dehydol ® O8 | — | — | — | — | — | 30.0 | — | — | — | — |
| Octanol + 6EO | | | | | | | | | | |
| Dehydol ® LT5 | — | — | — | — | — | — | 10.0 | — | 6.0 | — |
| Laurylstearyl Alcohol + 5EO | | | | | | | | | | |
| Dehydol ® L77 | 12.0 | — | — | — | 10.2 | — | — | 2.0 | 4.0 | — |
| Laurylstearyl Alcohol + 7EO | | | | | | | | | | |
| Emulgin ® WO 7 | — | — | 10.0 | 4.0 | — | — | — | — | — | — |
| Oleyl Alcohol + 7EO | | | | | | | | | | |
| Eumulgin ® RT 40 | — | — | — | — | — | — | — | — | — | 5.0 |
| Castor Oil + 40EO | | | | | | | | | | |
| Edenor ® K 1218 | 8.0 | — | 4.0 | — | — | 12.0 | — | — | — | — |
| Coconut Fatty Acid | | | | | | | | | | |
| Sokalan ® CP5 | — | — | — | 5.0 | — | — | — | 4.0 | 5.5 | — |
| Maleic Acid-Acrylic Acid Copolymer, Sodium Salt | | | | | | | | | | |
| Sodium Carbonate | — | 2.0 | — | 7.0 | — | — | 13.0 | 7.0 | 10.0 | — |
| Sodium Sulfate | — | — | — | 19.0 | — | — | — | 10.0 | 9.5 | 45.0 |
| Sodium Tripolyphosphate | — | 20.0 | — | — | — | — | — | — | — | — |
| Zeolite A | — | — | — | 25.0 | — | — | 39.0 | 25.0 | 32.5 | — |
| Amylase | — | — | — | — | — | — | 0.2 | — | 0.2 | — |
| Cellulase | — | — | — | — | — | — | 0.2 | — | — | — |
| Lipase | 0.8 | — | — | — | — | — | 0.2 | 0.7 | 0.1 | — |
| Protease | — | — | — | — | — | — | 0.2 | 0.3 | 0.1 | — |
| Glycerol | 3.0 | — | — | — | — | — | — | — | — | — |
| Propylene Glycol | 7.0 | — | 5.0 | — | — | — | — | — | — | — |
| Ethanol | 5.0 | — | 5.0 | — | — | 7.0 | — | — | — | — |
| Protil ® N | — | — | — | 3.0 | — | — | — | — | — | — |
| Sodium Silicate | | | | | | | | | | |
| Dehydran ® 750 | — | — | — | 7.0 | — | — | 4.0 | 5.0 | 4.5 | — |
| Silicone/Paraffin on carrier | | | | | | | | | | |
| Polyvinylpyrrolidone | — | — | — | — | — | — | 0.3 | 1.0 | 0.8 | — |
| Sodium Hydroxide | 5.5 | — | 5.0 | — | — | 7.6 | — | — | — | — |
| Sodium Hydrogencarbonate | — | — | — | — | — | — | 7.0 | 9.0 | 5.5 | — |
| Sodium Citrate | 0.1 | — | — | — | 0.1 | — | 4.0 | 12.0 | 4.0 | 5.0 |

| (1–6) light duty detergent (7–9) heavy duty detergent (10) toilet block<br>Composition (INCI) | 11 | 12 | 13 | 14 | 15 | 16 | 17 | 18 | 19 | 20 |
|---|---|---|---|---|---|---|---|---|---|---|
| Glucopon 600 CS UP Granulate as in Ex. 1 | 4.0 | 5.0 | 11.0 | 15.0 | 6.0 | 19.5 | 5.0 | 7.0 | 10.0 | 5.0 |
| Coco Glucosides | | | | | | | | | | |
| Maranil ® Paste A 55 | 20.0 | — | — | — | — | — | — | — | — | 6.0 |
| Dodecylbenzenesulfonate, Sodium Salt | | | | | | | | | | |
| Texapon ® NSO | 3.0 | 15.0 | — | — | 20.0 | — | — | 2.0 | — | — |
| Lauryl Alcohol + 2EO Sulfate, Sodium Salt | | | | | | | | | | |
| Texapon ® N 70 | — | — | 9.0 | — | — | — | — | — | — | — |
| Lauryl Alcohol + 2EO Sulfate, Sodium Salt | | | | | | | | | | |
| Texapon ® LS 35 | — | 10.0 | 2.0 | 5.0 | — | — | — | — | 2.0 | — |
| Lauryl Alcohol + 3.5EO Sulfate, Sodium Salt | | | | | | | | | | |
| Texapon ® 842 | 5.0 | 3.5 | — | — | — | — | — | — | — | — |
| Octyl Sulfate, Sodium Salt | | | | | | | | | | |
| Alkanesulfonate C13/17 | — | — | — | 12.5 | 18.0 | — | — | — | — | — |
| Glucopon ® 600 CS UP | 3.0 | 2.0 | 15.0 | 4.0 | — | — | — | 1.0 | — | — |
| Lauryl Glucoside | | | | | | | | | | |
| Dehydol ® O10 | — | — | — | — | 8.0 | — | — | — | — | — |
| Octanol + 10EO | | | | | | | | | | |
| Dehydol ® 980 | — | — | — | — | — | — | — | — | 1.0 | 2.0 |
| Laurylmyristyl Alcohol + 1PO + 6EO | | | | | | | | | | |
| Dehypon ® LS 54 | — | — | — | — | — | 15.0 | — | — | — | — |
| Lauryl Alcohol + 5EO + 4PO | | | | | | | | | | |
| Dehypon ® LS 104 | — | — | — | — | — | — | 10.0 | — | — | — |
| Lauryl Alcohol + 10EO Butyl Ether | | | | | | | | | | |
| Dehyton ® K | — | 3.5 | 5.0 | — | — | — | — | — | — | — |
| Coconut Fatty Acid Amidopropylbetaine | | | | | | | | | | |
| Sokalan ® DCS | — | — | 2.5 | — | — | — | — | — | — | — |
| Succinic Acid-Glutanic Acid-Adipic Acid Mixture | | | | | | | | | | |
| Ethanol | — | — | 8.0 | — | — | — | — | — | — | — |
| Isopropyl Alcohol | — | — | — | — | — | — | — | — | — | 3.0 |
| Butyl Diglycol | — | — | — | — | — | — | — | — | — | 1.5 |
| Cumenesulfonate, Sodium Salt | — | — | — | — | — | 20.0 | 13.0 | — | — | — |
| Sodium Hydroxide | — | — | 1.5 | — | — | — | — | — | — | — |
| Ammonia | — | — | — | — | — | — | — | — | — | 0.5 |
| Hydrogen Peroxide | — | — | — | — | — | — | — | 5.0 | 5.0 | — |
| Citric acid | 0.2 | 0.2 | 0.2 | 0.2 | 0.2 | — | 5.0 | — | — | — |
| Turpinal ® 4 NL | — | — | — | — | — | — | — | 0.3 | 0.3 | — |
| Tetrasodium Editronate | | | | | | | | | | |

(11–15) hand dishwashing detergent (16, 17) machine dishwashing detergent (18–20) cleaner

What is claimed is:

1. A granulated surfactant produced by a process comprising: (i) mixing an aqueous nonionic surfactant paste and an aqueous solution of an organic polymeric carrier selected from the group consisting of poly(meth)acrylates, polypeptides, polysaccharides, celluloses, polyvinyl alcohols, polyvinylpyrrolidones, polycondensates, polyhydroxycarboxylic acids, polyethylene glycols, polyesters, polyurethanes and mixtures thereof, to form a mixture which is free of added inorganic carrier materials; and (ii) simultaneously granulating and drying the mixture to form a granulated surfactant.

2. The granulated surfactant according to claim 1, wherein the nonionic surfactant is selected from the group consisting of alkyl and alkenyl oligoglycosides, fatty acid N-alkylpolyhydroxyalkylamides, alcohol ethoxylates, alkoxylated caboxylic acid esters, and mixtures thereof.

3. The granulated surfactant according to claim 1, wherein the nonionic surfactant is an alkyl and/or alkenyl oligoglycoside of the formula (I)

$$R^1O—[G]_p \quad (I)$$

wherein $R^1$ is an alkyl and/or alkenyl radical having from 4 to 22 carbon atoms, G is a sugar radical having from 5 or 6 carbon atoms and p is a number from 1 to 10.

4. The granulated surfactant according to claim 1, wherein the granulated nonionic surfactant has a particle size distribution between 0.02 and 2.0 mm.

5. The granulated surfactant according to claim 1, where the aqueous nonionic surfactant paste is further comprised of an anionic, zwitterionic, or amphoteric surfactant.

6. The granulated surfactant according to claim 1, wherein the mixture is simultaneously granulated and dried in a fluidized bed.

7. A method of making a granulated surfactant comprising: (i) mixing an aqueous nonionic surfactant paste and an aqueous solution of an organic polymeric carrier selected from the group consisting of poly(meth)acrylates, polypeptides, polysaccharides, celluloses, polyvinyl alcohols, polyvinylpyrrolidones, polycondensates, polyhydroxycarboxylic acids, polyethylene glycols, polyesters, polyurethanes and mixtures thereof, to form a mixture which is free of added inorganic carrier materials; and (ii) simultaneously granulating and drying the mixture to form a granulated nonionic surfactant.

8. The method according to claim 1, wherein the nonionic surfactant is selected from the group consisting of alkyl and alkenyl oligoglycosides, fatty acid N-alkylpolyhydroxyalkylamides, alcohol ethoxylates, alkoxylated carboxylic acid esters, and mixtures thereof.

9. The method according to claim 1, wherein the nonionic surfactant is an alkyl and/or alkenyl oligoglycoside of the formula (1)

$$R^1O—[G]_p \quad (1)$$

wherein $R^1$ is an alkyl and/or alkenyl radical having from 4 to 22 carbon atoms, G is a sugar radical having from 5 or 6 carbon atoms and p is a number from 1 to 10.

10. The method according to claim 7, wherein the granulated nonionic surfactant has a particle size distribution between 0.02 and 2.0 mm.

11. The method according to claim 7, wherein the mixture is simultaneously granulated and dried in a fluidized bed.

12. The method according to claim 7, wherein the aqueous nonionic surfactant paste is further comprised of an anionic, zwitterionic, or amphoteric surfactant.

* * * * *